US011548725B2

(12) United States Patent
Morgan

(10) Patent No.: US 11,548,725 B2
(45) Date of Patent: Jan. 10, 2023

(54) COVER SYSTEMS, TANK COVERING METHODS, AND PIPE RETENTION SYSTEMS

(71) Applicant: Michael A. Morgan, Edina, MN (US)

(72) Inventor: Michael A. Morgan, Edina, MN (US)

(73) Assignee: Industrial & Environmental Concepts, Inc., Lakeville, MN (US)

( * ) Notice: Subject to any disclaimer, the term of this patent is extended or adjusted under 35 U.S.C. 154(b) by 0 days.

(21) Appl. No.: 13/842,293

(22) Filed: Mar. 15, 2013

(65) Prior Publication Data

US 2014/0263345 A1 Sep. 18, 2014

(51) Int. Cl.

| | |
|---|---|
| ***B65D 90/04*** | (2006.01) |
| ***B65D 90/06*** | (2006.01) |
| ***B65D 88/34*** | (2006.01) |

(52) U.S. Cl.

CPC ..... *B65D 90/046* (2013.01); *B65D 88/34* (2013.01); *B65D 90/06* (2013.01)

(58) Field of Classification Search

CPC ..... B65D 88/34; B65D 88/38; B65D 90/046; B65D 90/06; B65D 88/46; B65D 88/42; B65D 88/76; B65D 88/78; B65D 25/14; E02D 31/002; E02D 31/004; E03F 1/002; B09B 1/00; B32B 27/12; B32B 7/12; B32B 27/32; B29C 66/7292; B29C 66/73921; B29C 66/723; B29C 66/53461; B29C 65/02; B29C 65/18; B29C 66/112; B29C 66/1122; B29C 66/114; B29C 66/1222; B29C 66/1224; B29C 66/1282; B29C 66/12841; B29C 66/131; B29C 66/43; B29C 65/00; B60K 2015/03046; B60K 2015/03052

USPC ..... 220/216, 495.01; 493/100; 156/69; 210/164, 282, 692, 693, 691, 163, 99

See application file for complete search history.

(56) References Cited

U.S. PATENT DOCUMENTS

| | | | | |
|---|---|---|---|---|
| 289,557 | A | 12/1883 | Reinecke | |
| 1,445,092 | A | 2/1923 | Kueffer | 88/46 |
| 1,493,091 | A | 5/1924 | Wiggins | 220/218 |
| 1,493,174 | A | 5/1924 | Wiggins | 220/224 |
| 1,493,344 | A | 5/1924 | Wilson | 88/34 |
| 1,513,043 | A | 10/1924 | Wilson | 220/222 |
| 1,514,116 | A | 11/1924 | Wiggins | 220/220 |
| 1,520,991 | A | 12/1924 | Wiggins | 220/219 |
| 1,529,767 | A | 3/1925 | Briers et al. | 220/219 |
| 1,559,016 | A | 10/1925 | Stovall | 220/219 |
| 1,574,011 | A | 2/1926 | Wiggins | 220/224 |
| 1,574,012 | A | 2/1926 | Wiggins | 220/220 |
| 1,574,013 | A | 2/1926 | Wiggins | 220/219 |
| 1,575,033 | A | 3/1926 | Bown | 220/219 |
| 1,580,194 | A | 4/1926 | Glass | 220/227 |
| 1,592,244 | A | 7/1926 | Wiggins | 220/219 |

(Continued)

OTHER PUBLICATIONS

S. Jianxia, in Comprehensive Renewable Energy; 6.14.5.1.5, Geomembranes (Year: 2012).*

*Primary Examiner* — King M Chu

(74) *Attorney, Agent, or Firm* — Norton Rose Fulbright US LLP

(57) ABSTRACT

Cover systems for storage tanks, such as those containing at least some petroleum. Pipe retention systems for retaining pipes to storage tanks, such as pipes that can transmit liquid containing at least some petroleum. Methods of attaching cover systems to tanks.

7 Claims, 16 Drawing Sheets

(56) References Cited

U.S. PATENT DOCUMENTS

| | | | | |
|---|---|---|---|---|
| 1,597,046 | A | 8/1926 | Bohnhardt | 220/225 |
| 1,628,246 | A | 5/1927 | Iddings | 220/219 |
| 1,636,539 | A | 7/1927 | Wiggins | 220/227 |
| 1,636,540 | A | 7/1927 | Wiggins | 220/219 |
| 1,639,625 | A | 8/1927 | Afonin | 220/218 |
| 1,650,340 | A | 11/1927 | Glass | 220/221 |
| 1,660,021 | A | 2/1928 | Wiggins | 220/226 |
| 1,662,225 | A | 3/1928 | Wiggins | 220/224 |
| 1,665,163 | A | 4/1928 | Gallagher | 220/219 |
| 1,666,415 | A | 4/1928 | Gallagher | 220/219 |
| 1,666,416 | A | 4/1928 | Griffin | 220/224 |
| 1,666,525 | A | 4/1928 | Bohnhardt | 220/225 |
| 1,666,667 | A | 4/1928 | Pew | 220/219 |
| 1,668,792 | A | 5/1928 | Wiggins | 220/222 |
| 1,671,650 | A | 5/1928 | Newman et al. | 169/57 |
| 1,673,983 | A | 6/1928 | Kuhl | 220/224 |
| 1,673,984 | A | 6/1928 | Kuhl | 220/224 |
| 1,674,038 | A | 6/1928 | Glass | 220/221 |
| 1,674,039 | A | 6/1928 | Glass | 220/218 |
| 1,674,104 | A | 6/1928 | Gallagher | 220/219 |
| 1,693,857 | A | 12/1928 | Moser | 220/219 |
| 1,698,158 | A | 1/1929 | Glass | 220/222 |
| 1,712,321 | A | 5/1929 | Afonin | 220/218 |
| 1,714,207 | A | 5/1929 | Bohnhardt | 220/218 |
| 1,714,209 | A | 5/1929 | Bohnhardt | 220/217 |
| 1,716,491 | A | 6/1929 | Griffin | 220/219 |
| 1,734,623 | A | 11/1929 | Griffin | 220/218 |
| 1,735,461 | A | 11/1929 | Haupt | 220/224 |
| 1,748,231 | A | 2/1930 | Kimbell | 220/218 |
| 1,754,596 | A | 4/1930 | Bohnhardt | 220/219 |
| 1,758,225 | A | 5/1930 | Johnson | 220/224 |
| 1,761,700 | A | 6/1930 | Bailey | 220/219 |
| 1,765,593 | A | 6/1930 | Kueffer | 220/219 |
| 1,767,142 | A | 6/1930 | Kramer | 220/219 |
| 1,774,943 | A | 9/1930 | Patterson | 220/227 |
| 1,775,758 | A | 9/1930 | George | 220/222 |
| 1,930,953 | A | 9/1930 | Hampton | 220/224 |
| 1,777,560 | A | 10/1930 | Griffin | 220/218 |
| 1,783,118 | A | 11/1930 | Griffin | 220/218 |
| 1,787,546 | A | 1/1931 | Patterson | 220/219 |
| 1,801,172 | A | 4/1931 | Patterson | 220/219 |
| 1,801,582 | A | 4/1931 | Wiggins | 220/224 |
| 1,909,484 | A | 4/1931 | Bjerregaard | 52/184 |
| 1,816,124 | A | 7/1931 | Patterson | 220/219 |
| 1,819,401 | A | 8/1931 | Bailey | 220/218 |
| 1,823,256 | A | 9/1931 | Clark | 220/565 |
| 1,825,639 | A | 9/1931 | Shanor | 220/224 |
| 1,831,020 | A | 11/1931 | Maker | 220/224 |
| 1,840,587 | A | 1/1932 | Kimbell | 220/219 |
| 1,854,534 | A | 4/1932 | Wiggins | 220/219 |
| 1,854,535 | A | 4/1932 | Wiggins | 220/222 |
| 1,857,362 | A | 5/1932 | Day | 220/219 |
| 1,861,860 | A | 6/1932 | Horton | 220/220 |
| 1,861,868 | A | 6/1932 | Larson | 220/221 |
| 1,867,845 | A | 7/1932 | Kimbell | 220/222 |
| 1,871,289 | A | 8/1932 | Wiggins | 220/224 |
| 1,872,735 | A | 8/1932 | Gunther | 52/3 |
| 1,874,726 | A | 8/1932 | Wiggins | 220/219 |
| 1,879,572 | A | 9/1932 | Speegle | 220/221 |
| 1,886,131 | A | 11/1932 | Smith | 220/219 |
| 1,888,079 | A | 11/1932 | Haupt | 220/227 |
| 1,890,189 | A | 12/1932 | Oswald | 220/219 |
| 1,892,144 | A | 12/1932 | Griffin | 220/224 |
| 1,893,162 | A | 1/1933 | Cranz | 220/222 |
| 1,894,535 | A | 1/1933 | Laird | 48/176 |
| 1,897,779 | A | 2/1933 | Wiggins | 220/219 |
| 1,900,904 | A | 3/1933 | Berger | 442/85 |
| 1,901,874 | A | 3/1933 | Horton | 220/221 |
| 1,902,108 | A | 3/1933 | Twogood | 220/219 |
| 1,903,291 | A | 4/1933 | Griffin | 220/224 |
| 1,903,306 | A | 4/1933 | Williams | 220/224 |
| 1,904,339 | A | 4/1933 | Wiggins | 220/227 |
| 1,913,643 | A | 6/1933 | Smith | 220/224 |
| 1,917,623 | A | 7/1933 | Wiggins | 220/721 |
| 1,919,634 | A | 7/1933 | Haupt et al. | 220/227 |
| 1,921,877 | A | 8/1933 | Hackett | 220/224 |
| 1,928,905 | A | 10/1933 | Meyers | 220/219 |
| 1,931,546 | A | 10/1933 | Horton | 220/221 |
| 1,931,551 | A | 10/1933 | Larson | 220/224 |
| 1,932,392 | A | 10/1933 | Bailey | 220/220 |
| 1,932,394 | A | 10/1933 | Boardman | 220/222 |
| 1,932,398 | A | 10/1933 | Day | 220/224 |
| 1,932,403 | A | 10/1933 | Garske | 220/218 |
| 1,958,437 | A | 5/1934 | Kramer | 220/219 |
| 1,976,592 | A | 10/1934 | Wiggins | 220/219 |
| 1,976,734 | A | 10/1934 | Kramer | 220/219 |
| 1,979,272 | A | 11/1934 | Kramer | 220/219 |
| 1,979,657 | A | 11/1934 | Wiggins | 220/224 |
| 1,986,869 | A | 1/1935 | Welp | 220/224 |
| 1,989,624 | A | 1/1935 | Matter | 220/219 |
| 1,990,627 | A | 2/1935 | Wiggins | 220/219 |
| 1,992,221 | A | 2/1935 | Kramer | 220/222 |
| 1,994,477 | A | 3/1935 | Kramer | 220/222 |
| 1,994,478 | A | 3/1935 | Kueffer | 220/220 |
| 2,006,505 | A | 7/1935 | Lentschewsky | 220/218 |
| 2,007,193 | A | 7/1935 | Griffin | 220/218 |
| 2,008,686 | A | 7/1935 | Day | 220/219 |
| 2,014,264 | A | 9/1935 | Patrick | 220/225 |
| 2,017,821 | A | 10/1935 | Shanor | 220/219 |
| 2,023,308 | A | 12/1935 | Cantacuzene | 220/227 |
| 2,024,327 | A | 12/1935 | Babcock | 220/222 |
| 2,026,762 | A | 1/1936 | Verner | 220/222 |
| 2,036,372 | A | 4/1936 | Stough | 220/222 |
| 2,070,828 | A | 2/1937 | Edwards et al. | 220/218 |
| 2,071,530 | A | 2/1937 | Howard et al. | 220/218 |
| 2,072,798 | A | 3/1937 | Cranz | 220/222 |
| 2,080,568 | A | 5/1937 | Hoenighausen | 220/224 |
| 2,082,194 | A | 6/1937 | Wiggins | 220/224 |
| 2,089,645 | A | 8/1937 | Dickmann | 220/227 |
| 2,092,877 | A | 9/1937 | Haupt et al. | 220/222 |
| 2,108,380 | A | 2/1938 | Lentschewsky | 220/224 |
| 2,125,771 | A | 8/1938 | De Castro | 220/225 |
| 2,145,812 | A | 1/1939 | Einbeck | 48/176 |
| 2,147,771 | A | 2/1939 | Hathaway | 215/231 |
| 2,148,811 | A | 2/1939 | Griffin | 220/224 |
| RE21,135 | E | 7/1939 | Otterbein | 220/220 |
| 2,180,587 | A | 11/1939 | Hammeren | 220/224 |
| 2,190,476 | A | 2/1940 | Haupt et al. | 220/222 |
| 2,193,484 | A | 3/1940 | Jones | 220/219 |
| 2,278,294 | A | 3/1942 | Wiggins | 220/219 |
| 2,280,657 | A | 4/1942 | McCandliss | 48/176 |
| 2,280,679 | A | 4/1942 | Hubert et al. | 48/176 |
| 2,280,768 | A | 4/1942 | Graver | 48/176 |
| 2,281,748 | A | 5/1942 | Carney | 220/227 |
| 2,282,773 | A | 5/1942 | Wiggins | 220/222 |
| 2,287,211 | A | 6/1942 | Wiggins | 220/224 |
| 2,287,212 | A | 6/1942 | Wiggins | 220/220 |
| RE22,169 | E | 9/1942 | Hammeren | 220/224 |
| 2,297,985 | A | 10/1942 | Rivers | 220/227 |
| 2,302,904 | A | 11/1942 | Wiggins | 220/224 |
| 2,307,508 | A | 1/1943 | Jayne | 220/222 |
| 2,313,856 | A | 3/1943 | Wiggins | 220/224 |
| 2,314,805 | A | 3/1943 | Wiggins | 220/222 |
| 2,315,023 | A | 3/1943 | Stevenson | 220/219 |
| 2,318,134 | A | 5/1943 | Wiggins | 220/224 |
| 2,318,135 | A | 5/1943 | Wiggins | 220/224 |
| 2,321,058 | A | 6/1943 | Wiggins | 220/219 |
| 2,327,083 | A | 8/1943 | Wiggins | 220/224 |
| 2,329,965 | A | 9/1943 | Wiggins | 220/224 |
| 2,329,966 | A | 9/1943 | Wiggins | 220/224 |
| 2,329,967 | A | 9/1943 | Wiggins | 220/220 |
| 2,344,436 | A | 3/1944 | Laird | 220/221 |
| 2,354,629 | A | 7/1944 | Wiggins | 220/224 |
| 2,359,416 | A | 10/1944 | Hammeren | 220/219 |
| 2,359,723 | A | 10/1944 | Hammeren | 220/219 |
| 2,366,911 | A | 1/1945 | Laird | 220/225 |
| 2,386,022 | A | 10/1945 | Wiggins | 220/219 |
| 2,459,178 | A | 10/1945 | Moyer | 220/224 |
| 2,390,141 | A | 12/1945 | Wiggins | 220/219 |
| 2,411,262 | A | 11/1946 | Graver | 48/176 |
| 2,422,322 | A | 6/1947 | Ulm | 220/219 |
| 2,425,771 | A | 8/1947 | Wiggins | 220/219 |
| 2,426,755 | A | 9/1947 | Ulm | 220/225 |
| 2,427,171 | A | 9/1947 | Wiggins | 220/222 |

(56) References Cited

U.S. PATENT DOCUMENTS

| | | | | |
|---|---|---|---|---|
| 2,430,592 | A | 11/1947 | Wiggins | 220/219 |
| 2,436,942 | A | 3/1948 | Shanor | 220/224 |
| 2,437,125 | A | 3/1948 | Plummer | 220/221 |
| 2,450,758 | A | 10/1948 | Laird | 220/219 |
| 2,460,053 | A | 1/1949 | Wiggins | 220/219 |
| 2,461,763 | A | 2/1949 | Offenhouser | 220/221 |
| 2,464,786 | A | 3/1949 | Allen | 220/219 |
| 2,464,803 | A | 3/1949 | Goldsby et al. | 220/220 |
| 2,464,804 | A | 3/1949 | Goldsby et al. | 220/224 |
| 2,471,404 | A | 5/1949 | Boberg | 220/224 |
| 2,478,422 | A | 8/1949 | Plummer | 220/224 |
| 2,490,767 | A | 12/1949 | Allen | 220/225 |
| 2,495,742 | A | 1/1950 | Lebedeff | 220/224 |
| 2,495,755 | A | 1/1950 | Goldsby et al. | 220/224 |
| 2,497,047 | A | 2/1950 | Prager et al. | 220/219 |
| 2,497,645 | A | 2/1950 | Wiggins | 220/219 |
| 2,497,850 | A | 2/1950 | Allen | 220/225 |
| 2,516,101 | A | 7/1950 | Boberg | 220/225 |
| 2,518,488 | A | 8/1950 | Fraser et al. | 220/224 |
| 2,522,245 | A | 9/1950 | Wiggins | 220/224 |
| 2,523,292 | A | 9/1950 | Goldsby et al. | 220/226 |
| 2,531,424 | A | 11/1950 | Goldsby et al. | 220/225 |
| 2,531,897 | A | 11/1950 | Ulm | 29/467 |
| 2,531,898 | A | 11/1950 | Ulm | 220/219 |
| 1,865,969 | A | 1/1951 | Goldsby et al. | 220/222 |
| 2,536,019 | A | 1/1951 | Allen | 220/224 |
| 2,536,077 | A | 1/1951 | Orr et al. | 220/227 |
| 2,537,986 | A | 1/1951 | Goldsby et al. | 220/222 |
| 2,537,987 | A | 1/1951 | Goldsby et al. | 220/224 |
| 2,538,032 | A | 1/1951 | Goldsby et al. | 220/219 |
| 2,538,033 | A | 1/1951 | Orr | 220/219 |
| 2,538,067 | A | 1/1951 | Wilber | 220/224 |
| 2,538,875 | A | 1/1951 | Laird | 220/225 |
| 2,540,801 | A | 2/1951 | Wiggins | 220/224 |
| 2,540,802 | A | 2/1951 | Wiggins | 220/222 |
| 2,541,049 | A | 2/1951 | Goldsby et al. | 220/219 |
| 2,542,444 | A | 2/1951 | Wilkin | 220/224 |
| 2,551,403 | A | 5/1951 | Wiggins | 220/222 |
| 2,554,497 | A | 5/1951 | Moyer | 220/224 |
| 2,560,586 | A | 7/1951 | Michaels | 220/219 |
| 2,563,016 | A | 8/1951 | Feild | 220/225 |
| 2,563,017 | A | 8/1951 | Feild | 220/219 |
| 2,564,711 | A | 8/1951 | Allen et al. | 220/227 |
| 2,567,920 | A | 9/1951 | Allen | 220/219 |
| 2,568,529 | A | 9/1951 | Wiggins | 220/222 |
| 2,568,728 | A | 9/1951 | Goldsby et al. | 220/224 |
| 2,571,817 | A | 10/1951 | Armstrong | 48/176 |
| 2,576,136 | A | 11/1951 | Moyer | 220/224 |
| 2,586,813 | A | 2/1952 | Goldsby et al. | 220/224 |
| 2,586,856 | A | 2/1952 | Goldsby et al. | 220/219 |
| 2,587,508 | A | 2/1952 | Moyer et al. | 220/224 |
| 2,600,237 | A | 6/1952 | Graham | 220/224 |
| 2,601,316 | A | 6/1952 | Moyer | 220/219 |
| 2,601,317 | A | 6/1952 | Moyer | 220/227 |
| 2,718,977 | A | 7/1952 | Wiggins | 220/227 |
| 2,614,717 | A | 10/1952 | Wiggins | 220/219 |
| 2,616,586 | A | 11/1952 | Lamb | 220/218 |
| 2,619,252 | A | 11/1952 | De Hoffmann | 220/227 |
| 2,630,937 | A | 3/1953 | Bannister | 220/224 |
| 2,634,017 | A | 4/1953 | Moyer | 220/222 |
| 2,635,782 | A | 4/1953 | Orr | 220/219 |
| 2,643,023 | A | 6/1953 | Moyer | 220/219 |
| 2,647,654 | A | 8/1953 | Cibulka | 220/219 |
| 2,648,457 | A | 8/1953 | Moyer | 220/220 |
| 2,649,985 | A | 8/1953 | Moyer | 220/224 |
| 2,650,738 | A | 9/1953 | Ulm | 220/223 |
| 2,651,433 | A | 9/1953 | Mjellem | 220/222 |
| 2,657,821 | A | 11/1953 | Moyer | 220/219 |
| 2,663,452 | A | 12/1953 | Wiggins | 220/227 |
| 2,663,453 | A | 12/1953 | Allen et al. | 220/227 |
| 2,664,220 | A | 12/1953 | Cord et al. | 220/219 |
| 2,669,371 | A | 2/1954 | Ulm | 220/219 |
| 2,669,372 | A | 2/1954 | Allen et al. | 220/224 |
| 2,696,930 | A | 12/1954 | Moyer | 220/224 |
| 2,717,095 | A | 9/1955 | Gable | 220/219 |
| 2,718,976 | A | 9/1955 | Wiggins | 220/219 |
| 2,723,908 | A | 11/1955 | Allen et al. | 48/178 |
| 2,735,573 | A | 2/1956 | Fino | 220/225 |
| 2,735,574 | A | 2/1956 | Williams | 220/220 |
| 2,737,310 | A | 3/1956 | Ulm | 220/222 |
| 2,740,549 | A | 4/1956 | Ghraham | 220/222 |
| 2,750,067 | A | 6/1956 | Wiggins | 220/219 |
| 2,754,026 | A | 7/1956 | Wiggins | 220/224 |
| 2,772,805 | A | 12/1956 | Grundig | 220/220 |
| 2,778,719 | A | 1/1957 | Wiggins | 48/176 |
| 2,784,863 | A | 3/1957 | Fabian | 220/224 |
| 2,788,913 | A | 4/1957 | Allen | 220/222 |
| 2,789,722 | A | 4/1957 | Oberst | 220/219 |
| 2,790,574 | A | 4/1957 | Consani | 220/221 |
| 2,798,633 | A | 7/1957 | Cornell et al. | 220/221 |
| 2,801,763 | A | 8/1957 | Ulm | 220/224 |
| 2,802,591 | A | 8/1957 | Wiggins | 220/219 |
| 2,803,371 | A | 8/1957 | Edens | 220/224 |
| 2,804,228 | A | 8/1957 | Hartley | 220/218 |
| 2,806,625 | A | 9/1957 | Wiggins | 220/219 |
| 2,829,795 | A | 4/1958 | Moyer | 220/222 |
| 2,838,199 | A | 6/1958 | Wiggins | 220/216 |
| 2,839,216 | A | 6/1958 | Schenck | 220/222 |
| 2,840,260 | A | 6/1958 | Wiggins | 220/224 |
| 2,843,289 | A | 7/1958 | Ulm | 220/219 |
| 2,846,108 | A | 8/1958 | Aller | 220/224 |
| 2,846,109 | A | 8/1958 | Larsen | 220/219 |
| 2,847,142 | A | 8/1958 | Martz et al. | 220/222 |
| 2,854,223 | A | 9/1958 | Lee | 165/47 |
| 2,855,122 | A | 10/1958 | Ulm et al. | 220/219 |
| 2,857,072 | A | 10/1958 | Brodley | 220/219 |
| 2,861,713 | A | 11/1958 | Grassick | 220/220 |
| 2,867,347 | A | 1/1959 | Champagnat | 220/216 |
| 2,873,042 | A | 2/1959 | Fino | 220/222 |
| 2,883,676 | A | 4/1959 | Kwake | 4/503 |
| 2,884,156 | A | 4/1959 | Graham et al. | 220/224 |
| 2,886,204 | A | 5/1959 | Moyer et al. | 220/219 |
| 2,888,161 | A | 5/1959 | Springer | 220/224 |
| 2,986,302 | A | 5/1959 | Paulet | 220/218 |
| 2,888,717 | A | 6/1959 | Domitrovic | 52/3 |
| 2,897,998 | A | 8/1959 | Ulm | 220/224 |
| 2,913,138 | A | 11/1959 | Swick | 220/219 |
| 2,914,212 | A | 11/1959 | Fino | 220/222 |
| 2,919,047 | A | 12/1959 | Fino | 220/222 |
| 2,931,534 | A | 4/1960 | Wiggins | 220/219 |
| 2,936,925 | A | 5/1960 | Moyer et al. | 220/224 |
| 2,960,252 | A | 11/1960 | Ulm | 220/224 |
| 2,968,420 | A | 1/1961 | Harris et al. | 220/225 |
| 2,970,716 | A | 2/1961 | McCammon | 220/218 |
| 2,973,113 | A | 2/1961 | Fino | 220/224 |
| 2,974,822 | A | 3/1961 | Trimble | 220/218 |
| 2,981,436 | A | 4/1961 | Fino et al. | 220/223 |
| 2,981,437 | A | 4/1961 | Wissmiller | 220/225 |
| 2,981,438 | A | 4/1961 | Heisterberg | 220/219 |
| 2,987,215 | A | 6/1961 | Joor | 220/224 |
| 2,997,200 | A | 8/1961 | Giannini et al. | 220/222 |
| 3,002,828 | A | 10/1961 | Fino et al. | 48/174 |
| 3,014,613 | A | 12/1961 | Anderson | 220/225 |
| 3,019,935 | A | 2/1962 | Anderson | 220/224 |
| 3,029,971 | A | 4/1962 | Reynolds | 220/218 |
| 3,033,413 | A | 5/1962 | Fino et al. | 220/223 |
| 3,036,342 | A | 5/1962 | Fino | 264/46.4 |
| 3,043,468 | A | 7/1962 | Horner | 220/226 |
| 3,048,298 | A | 8/1962 | Atkinson et al. | 220/224 |
| 3,054,526 | A | 9/1962 | Mercier | 220/226 |
| 3,055,533 | A | 9/1962 | Reese et al. | 220/226 |
| 3,057,507 | A | 10/1962 | Moyer et al. | 220/219 |
| 3,059,805 | A | 10/1962 | Joor | 220/224 |
| 3,059,806 | A | 10/1962 | Joor | 220/225 |
| 3,074,587 | A | 1/1963 | Jennings | 220/219 |
| 3,075,668 | A | 1/1963 | Reese | 220/226 |
| 3,079,029 | A | 2/1963 | Moyer et al. | 220/226 |
| 3,079,030 | A | 2/1963 | Moyer | 220/218 |
| 3,104,775 | A | 9/1963 | Champagnat | 220/220 |
| 3,106,309 | A | 10/1963 | Bagwell et al. | 220/222 |
| 3,106,310 | A | 10/1963 | Scherer | 220/222 |
| 3,116,850 | A | 1/1964 | Anderson et al. | 220/225 |
| 3,119,510 | A | 1/1964 | Wiggins | 220/226 |
| 3,119,511 | A | 1/1964 | Giannini | 220/226 |

(56) References Cited

U.S. PATENT DOCUMENTS 3,120,273 A 2/1964 Kaufman et al. 169/57
3,120,320 A 2/1964 Wissmiller 220/225
3,120,902 A 2/1964 Sabin et al. 220/218
3,125,346 A 3/1964 Poltorak 277/311
3,134,501 A 5/1964 Bodley 220/218
3,135,415 A 6/1964 Fino 220/225
3,136,444 A 6/1964 Moyer 220/226
3,154,213 A 10/1964 Ulm 220/225
3,154,214 A 10/1964 Baker 220/219
3,158,280 A 11/1964 Wiggins 220/226
3,159,301 A 12/1964 Anderson 220/222
3,167,206 A 1/1965 Nelson 220/224
3,186,578 A 6/1965 Bodley et al. 220/225
3,191,799 A 6/1965 Figge 220/695
3,203,574 A 8/1965 Bodley 220/227
3,204,808 A 9/1965 Cadwell 220/223
3,204,809 A 9/1965 Cadwell 220/222
3,228,551 A 1/1966 Marulic 220/227
3,228,702 A 1/1966 Ulm et al. 277/583
3,253,732 A 5/1966 Dempster 220/222
3,255,914 A 6/1966 Nelson 220/225
3,261,496 A 7/1966 Joor 220/225
3,269,583 A 8/1966 Fino 220/226
3,275,183 A 9/1966 Challenger 220/222
3,288,322 A 11/1966 Marshall et al. 220/226
3,307,733 A 3/1967 De Bock 220/226
3,308,984 A 3/1967 Baker 220/224
3,313,443 A 4/1967 Dial et al. 220/219
3,325,041 A 6/1967 Wiggins 220/224
3,329,301 A 7/1967 Lee et al. 220/227
3,330,118 A 7/1967 Biais 405/53
3,333,725 A 8/1967 Hirata et al. 220/226
3,338,454 A 8/1967 Nelson 220/224
3,343,708 A 9/1967 Haas 220/225
3,349,953 A * 10/1967 Conaway B65D 90/52 220/88.1
3,357,591 A 12/1967 David 220/222
3,362,562 A 1/1968 Marshall et al. 220/218
3,372,831 A 3/1968 Creith et al. 220/222
3,373,891 A 3/1968 Kidd 220/222
3,373,893 A 3/1968 Dunkelis 220/222
3,375,951 A 4/1968 Donald 220/222
3,390,803 A 7/1968 Smith 220/224
3,398,851 A 8/1968 Challenger et al. 220/224
3,421,650 A 1/1969 Yumoto 220/222
3,422,981 A 1/1969 McBrien et al. 220/224
3,423,264 A * 1/1969 Summerfelt B29C 70/10 156/293
3,424,335 A 1/1969 Wiltshire 220/222
3,426,934 A 2/1969 Marulic 220/226
3,434,619 A 3/1969 Nelson 220/224
3,434,815 A 3/1969 Wiggins 48/178
3,438,758 A 4/1969 Wiggins 48/174
3,439,829 A 4/1969 Heisterberg et al. 220/222
3,445,026 A 5/1969 Korn 220/220
3,462,040 A 8/1969 Galloway 220/218
3,469,731 A 9/1969 Brucker 220/222
3,474,931 A 10/1969 Creith et al. 220/219
3,493,143 A 2/1970 Heisterberg et al. 220/218
3,497,103 A 2/1970 Brady et al. 220/219
3,511,406 A 5/1970 Creith et al. 220/222
3,565,279 A 2/1971 Joor 220/224
3,583,594 A 6/1971 Belanger et al. 220/220
3,587,911 A 6/1971 Creith 220/220
3,589,549 A 6/1971 Heisterberg 220/222
3,592,009 A 7/1971 Glijnis et al. 504/53
3,595,432 A 7/1971 Bruijn et al. 220/224
3,606,071 A 9/1971 Kinghorn et al. 220/219
3,618,812 A 11/1971 Maeder et al. 220/220
3,618,813 A 11/1971 Nishkian et al. 220/222
3,623,629 A * 11/1971 Hendershot 220/661
3,647,113 A 3/1972 Belleli 220/219
3,667,641 A 6/1972 Dial 220/219
3,690,502 A 9/1972 Guber 220/219
3,724,704 A 4/1973 Edwards et al. 220/226
3,724,705 A 4/1973 McKibbin 220/225
3,735,891 A 5/1973 Nishkian et al. 220/222
3,795,339 A 3/1974 Barbier 220/222
3,815,775 A 6/1974 Strunc et al. 220/220
3,861,555 A 1/1975 Nelson 220/221
3,862,701 A 1/1975 Strunc et al. 220/227
3,883,032 A 5/1975 Fisher 220/219
3,885,699 A 5/1975 Pladys 220/225
3,892,332 A 7/1975 Iwagami et al. 220/219
3,910,452 A 10/1975 Szasz 220/226
3,915,332 A 10/1975 Pladys 220/220
3,926,332 A 12/1975 Okamoto 220/226
3,938,338 A 2/1976 Cullen 405/21
3,942,674 A 3/1976 Nelson 220/221
3,944,113 A 3/1976 Heisterberg 220/219
3,972,444 A 8/1976 Adams 220/222
3,980,199 A 9/1976 Kays 220/227
3,991,900 A 11/1976 Burke et al. 220/219
3,993,214 A 11/1976 Usab 220/218
4,004,708 A 1/1977 Boyd 220/224
4,014,454 A 3/1977 Nayler et al. 220/225
4,018,356 A 4/1977 Szasz et al. 220/220
4,024,983 A 5/1977 Muehl 220/316
RE29,270 E 6/1977 Nelson 220/220
4,034,887 A 7/1977 Sherlock 220/219
4,035,149 A 7/1977 Scott et al. 422/42
4,036,394 A 7/1977 Bodley et al. 220/222
4,036,395 A 7/1977 Tuckey 220/224
4,067,476 A 1/1978 Strozzi 220/224
4,071,164 A 1/1978 Skakunov 220/224
4,099,643 A 7/1978 Wardwell et al. 220/222
4,099,644 A 7/1978 Nuttall et al. 220/225
4,116,358 A 9/1978 Kinghorn et al. 220/222
4,126,243 A 11/1978 Bruening 220/224
4,130,216 A 12/1978 Creith 220/224
4,130,217 A 12/1978 Hills et al. 220/226
4,134,515 A 1/1979 Hills et al. 220/219
4,138,032 A 2/1979 McCabe 220/224
4,139,117 A 2/1979 Dial 220/218
4,147,274 A 4/1979 Hall et al. 220/226
4,148,361 A 4/1979 Christensen 169/66
4,154,358 A 5/1979 Nayler et al. 220/222
4,154,359 A 5/1979 Bissett 220/222
4,162,022 A 7/1979 Fox 220/224
RE30,146 E 11/1979 Dial et al. 220/219
4,173,291 A 11/1979 Hills 220/225
4,174,785 A 11/1979 Garnett 220/224
4,189,058 A 2/1980 Seliskar et al. 220/218
4,191,303 A 3/1980 Kinghorn et al. 220/222
4,197,595 A 4/1980 Dearing 4/503
4,199,074 A 4/1980 Gammell et al. 220/218
4,202,366 A 5/1980 Kamvachirapitag 137/172
4,202,460 A 5/1980 Imbeault 220/218
4,213,280 A 7/1980 Sandborn 52/309.9
4,214,671 A 7/1980 McKibbin et al. 220/219
4,243,151 A 1/1981 Bruening 220/216
4,244,487 A 1/1981 Kern 220/216
4,248,357 A 2/1981 Stafford 220/219
4,258,858 A 3/1981 Russell 220/222
4,260,068 A 4/1981 McCarthy et al. 220/221
4,273,250 A 6/1981 Kinghorn et al. 220/222
4,276,991 A 7/1981 Gunther 220/223
4,286,726 A 9/1981 Madsen 220/220
4,287,999 A 9/1981 Heisterberg 220/222
4,308,968 A 1/1982 Thiltgen et al. 220/222
4,313,457 A 2/1982 Cliff 137/312
4,317,528 A 3/1982 Swain et al. 220/224
4,339,052 A 7/1982 Hills et al. 220/226
4,341,323 A 7/1982 Kerby 220/224
4,353,477 A 10/1982 Bruening 220/224
4,353,478 A 10/1982 Clark 220/224
4,369,044 A 1/1983 Heisterberg 48/176
4,371,090 A 2/1983 Ogarek et al. 220/224
4,391,705 A 7/1983 Cook et al. 210/218
4,397,399 A 8/1983 Wagoner 220/222
4,401,306 A 8/1983 Arnold 277/558
4,406,377 A 9/1983 Bruening 220/222
4,413,747 A 11/1983 Tenold et al. 220/225
4,431,536 A 2/1984 Thompson 210/123

(56) References Cited

U.S. PATENT DOCUMENTS 4,437,577 A 3/1984 Myers et al. ..... 220/224
4,438,863 A 3/1984 Wilson et al. ..... 220/227
4,446,983 A 5/1984 Gerber ..... 220/219
4,450,855 A 5/1984 Hills ..... 137/312
4,456,144 A 6/1984 Imhof ..... 220/222
4,457,446 A 7/1984 Bruening ..... 220/224
4,476,992 A 10/1984 Gerber ..... 220/219
4,493,430 A 1/1985 Sie ..... 220/224
4,503,988 A 3/1985 Gerber ..... 220/219
4,512,883 A 4/1985 Thompson ..... 210/123
4,524,878 A 6/1985 Imhof ..... 220/224
4,537,211 A 8/1985 Almeida ..... 137/1
4,540,104 A 9/1985 Kawai et al. ..... 220/224
4,596,266 A 6/1986 Kinghorn et al. ..... 137/172
4,603,790 A 8/1986 Gerber ..... 220/219
4,615,458 A 10/1986 Grove et al. ..... 220/222
4,648,968 A 3/1987 Cutler ..... 210/218
4,678,375 A * 7/1987 Gagle et al. ..... 405/270
4,705,185 A 11/1987 Barbillat ..... 220/222
4,714,175 A 12/1987 Coers ..... 220/216
4,723,682 A 2/1988 Barbillat ..... 220/227
4,790,446 A 12/1988 Thiltgen ..... 220/219
4,790,447 A 12/1988 Lenny ..... 220/220
4,811,859 A 3/1989 Kinghorn ..... 220/224
4,842,160 A 6/1989 Piso ..... 220/225
4,957,214 A 9/1990 Lenny ..... 220/220
4,971,217 A 11/1990 Robertson et al. ..... 220/218
5,005,724 A 4/1991 Imhof ..... 220/222
5,036,995 A 8/1991 Wagoner ..... 220/224
5,074,427 A 12/1991 Siemerink et al. ..... 220/218
5,078,293 A 1/1992 Lippiello ..... 220/221
5,103,992 A 4/1992 Lippiello et al. ..... 220/221
5,123,559 A 6/1992 Qiu et al. ..... 220/218
5,137,167 A 8/1992 Ploeger ..... 220/224
5,147,418 A 9/1992 Laverman et al. ..... 95/90
5,150,805 A 9/1992 Vinals ..... 220/217
5,184,504 A * 2/1993 Spring ..... G01M 3/32 73/49.2
5,212,090 A 5/1993 Landine et al. ..... 435/283.1
5,230,436 A 7/1993 Vaugn ..... 220/220
5,265,976 A * 11/1993 Russell ..... E04H 4/106 405/52
5,284,269 A 2/1994 Petrie et al. ..... 220/224
5,301,828 A 4/1994 McKay ..... 220/221
5,305,904 A 4/1994 Cutts ..... 220/220
5,305,905 A 4/1994 Zizinia ..... 220/220
5,351,848 A 10/1994 Wagoner ..... 220/224
5,353,941 A 10/1994 Benvegnu et al. ..... 220/220
5,372,270 A 12/1994 Rosenkrantz ..... 220/224
5,423,446 A 6/1995 Johnson ..... 220/216
5,490,605 A 2/1996 Cutts ..... 220/211
5,509,562 A 4/1996 Jolly ..... 220/216
5,515,989 A 5/1996 Petrie et al. ..... 220/224
5,529,200 A 6/1996 Ford et al. ..... 220/218
5,558,245 A * 9/1996 White ..... B65D 90/046 137/343
5,628,421 A 5/1997 Jolly ..... 220/216
5,667,091 A 9/1997 Slaber et al. ..... 220/224
5,704,509 A 1/1998 Rosenkrantz ..... 220/216
5,747,134 A * 5/1998 Mohammed ..... 428/57
5,758,792 A 6/1998 Jolly ..... 220/219
5,927,534 A 7/1999 King et al. ..... 220/224
6,164,479 A 12/2000 Kern ..... 220/216
6,193,092 B1 2/2001 Witter ..... 220/218
6,247,607 B1 6/2001 King ..... 220/221
6,354,488 B1 3/2002 Gallagher ..... 220/221
6,357,964 B1 3/2002 DeGarie ..... 405/52
6,497,533 B2 12/2002 DeGarie ..... 405/52
6,505,445 B2 1/2003 Johnson et al. ..... 52/223.3
6,659,688 B2 12/2003 Baumgartner ..... 405/129.9
6,851,891 B2 2/2005 Baumgartner et al. .... 405/129.9
6,865,754 B2 3/2005 MacLean et al. ..... 4/503
6,922,956 B2 8/2005 Johnson et al. ..... 52/192
6,929,142 B2 8/2005 Gilbert et al. ..... 220/216
7,044,322 B2 5/2006 Owens et al. ..... 220/224
7,128,831 B2 * 10/2006 Newman ..... E02D 31/002 210/99
7,225,942 B2 6/2007 Song ..... 220/218
7,240,804 B2 7/2007 King et al. ..... 220/218
7,374,059 B2 5/2008 Morgan et al. ..... 220/216
7,721,903 B2 5/2010 Ben Afeef ..... 220/219
7,748,555 B2 7/2010 Owens et al. ..... 220/224
8,061,552 B2 11/2011 Hiner ..... 220/811
8,177,090 B2 5/2012 Al-Farraj ..... 220/219
8,272,524 B2 9/2012 Alajlani et al. ..... 220/219
8,302,797 B2 11/2012 Ben Afeef ..... 220/219
8,342,352 B2 1/2013 Alirol ..... 220/218
1,404,924 A1 1/2022 Ralph ..... 88/42
1,426,997 A1 8/2022 Russell et al. ..... 88/46
1,426,998 A1 8/2022 Russell et al. ..... 88/46
1,426,999 A1 8/2022 Russell et al. ..... 88/46
2003/0042256 A1 3/2003 Johnson et al. ..... 220/216
2004/0112897 A1 6/2004 Owens et al. ..... 220/224
2004/0188438 A1 9/2004 King et al. ..... 220/218
2005/0072782 A1 4/2005 Owens et al. ..... 220/224
2006/0076351 A1 4/2006 King et al. ..... 220/218
2007/0272692 A1 11/2007 Hiner ..... 220/219
2008/0155918 A1 7/2008 Ben Afeef ..... 52/302.7
2008/0223859 A1 9/2008 Hiner ..... 220/567.2
2008/0314901 A1 * 12/2008 MacQueen et al. ..... 220/216
2009/0114655 A1 5/2009 Weatherstone et al. ..... 220/495.05
2009/0266817 A1 10/2009 Hilliard et al. ..... 220/224
2009/0321447 A1 12/2009 Imhof ..... 220/222
2010/0230409 A1 9/2010 Alajlani et al. ..... 220/203.23
2010/0258561 A1 10/2010 Farraj Al-Farraj ..... 220/219
2011/0233215 A1 9/2011 Ben Afeef ..... 220/567.2
2012/0091135 A1 4/2012 Ben Afeef ..... 220/220
2012/0152950 A1 6/2012 Al-Subaiey ..... 220/219
2013/0045353 A1 * 2/2013 Menage ..... B32B 27/30 428/76

* cited by examiner

COVER SYSTEMS, TANK COVERING METHODS, AND PIPE RETENTION SYSTEMS

BACKGROUND

1. Field of the Invention

This disclosure relates generally to cover systems, tank covering methods, and pipe retention systems, especially, but not only, for use in industries that extract oil. For example, this disclosure relates to cover systems for use in covering tanks holding liquids that contain petroleum.

SUMMARY

Some embodiments of the present cover systems are configured to be attached to a tank holding fluid that includes hydrocarbons (more specifically oil, and even more specifically petroleum). Some such embodiments comprise a first geomembrane that is hydrocarbon-resistant (more specifically oil-resistant, and even more specifically petroleum-resistant, as is true of any of the present geomembranes) and configured to substantially cover a tank. Some more specific embodiments also comprise a second geomembrane that is hydrocarbon-resistant (more specifically oil-resistant, and even more specifically petroleum-resistant, as is true of any of the present geomembranes) and configured to line substantially all of the interior of a tank. Some of these embodiments may also comprise one or more fasteners for attaching the first geomembrane to a tank and/or to the second geomembrane, and/or may further comprise one or more fasteners for attaching the second geomembrane to a tank. In some such embodiments, one or both of the first and second geomembranes are sufficiently flexible that at least portions of a given one of the geomembranes can fold over on themselves without destroying the geomembrane or, in some embodiments, without compromising the structural integrity of the geomembrane. Some of these embodiments may also comprise one or more floats, which can include closed-cell foam, that can be positioned over and/or under (and in some embodiments, attached to) at least a portion of the first geomembrane (and/or attached to a tank) and over fluid in a tank (the fluid containing hydrocarbons, oil, and/or petroleum). Some of these embodiments may also comprise one or more weights, which can include pipes and/or sand, that can be placed (and, in some embodiments, attached) on top of the first geomembrane when the first geomembrane is attached to a tank. Some of these embodiments may also comprise a structure configured to be attached to a tank and to retain one or more pipes that can transport fluids (including at least one of a liquid and a gas) into and/or out of the tank to which the structure is attached; such structures may, in some embodiments, comprise two portions that are angled with respect to each other, one of which includes an open region (such as an enclosed opening or a slot that is not completely enclosed) sized such that such a pipe may be positioned in the open region, and, in some more specific embodiments, configured such that multiple such pipes may be so positioned. In some embodiments, the structure may take the form of a flange, and the portion configured with an open region may have, in some embodiments, a rectangular shape or a non-rectangular shape (such as a trapezoidal shape); in some such embodiments, the portion that includes the open region may be oriented at an angle relative to the other portion of the structure such that when the structure is attached to a tank, the portion that includes the open region may extend into the tank (meaning into the region of the tank that is bounded by the side wall or side walls of the tank (where liquid can be held)). The tank may have any shape, including cylindrical, square, and rectangular, and may comprise one or more of concrete, fiberglass, and steel. In some embodiments, the system also includes a passive vent in the first geomembrane. In some embodiments, the system also includes a sump that can be positioned on top of the first geomembrane.

Some embodiments of the present methods comprise lining a tank with a hydrocarbon-resistant geomembrane liner (more specifically oil-resistant, and even more specifically petroleum-resistant, as is true of any of the present geomembrane liners) such that substantially all of the inside of the tank will be separated from fluid that can be held in the liner, and attaching the liner to the tank. Some embodiments of such methods may include assembling (e.g., attaching to one or more of each other) multiple pieces to form a cover comprising a hydrocarbon-resistant geomembrane (more specifically oil-resistant, and even more specifically petroleum-resistant). Some embodiments of such methods may include attaching the geomembrane cover to the tank to substantially cover the tank. Some of these embodiments may also comprise attaching the geomembrane cover to the geomembrane liner; in some such embodiments, at least a portion of the cover may be in direct contact with at least a portion of the liner. Some embodiments of such methods may include positioning one or more floats under and/or over the geomembrane cover, and, in some embodiments, attaching the one of more of such floats to the geomembrane cover and/or the tank. Some embodiments of such methods may also include positioning one or more weights, which can include pipes and/or sand, on top of the geomembrane cover. In some such embodiments, one or both of the geomembrane cover and liner are sufficiently flexible that at least portions of either can fold over on themselves without destroying the geomembrane cover/liner or, in some embodiments, without compromising the structural integrity of the geomembrane cover/liner. Some of these embodiments may also comprise attaching a structure to the tank that is configured to retain one or more pipes that can transport fluids (including at least one of a liquid and a gas) into and/or out of the tank; such structures may, in some embodiments, comprise two portions that are angled with respect to each other, one of which includes an open region (such as an enclosed opening or a slot that is not completely enclosed) sized such that such a pipe may be positioned in the open region, and, in some more specific embodiments, configured such that multiple such pipes may be so positioned. In some embodiments, the structure may take the form of a flange, and the portion configured with an open region may have, in some embodiments, a rectangular shape or a non-rectangular shape (such as a trapezoidal shape); in some such embodiments, the portion that includes the open region may be oriented at an angle relative to the other portion of the structure such that when the structure is attached to a tank, the portion that includes the open region may extend into the tank (meaning into the region of the tank that is bounded by the side wall or side walls of the tank (where liquid can be held)). Some embodiments of these methods may include positioning one or more pipes in such open region. Some embodiments of these methods may include attaching at least one of the geomembrane cover and the geomembrane liner to the pipe-retention structure. The tank to which the geomembrane cover and/or geomembrane liner may be attached may have any shape, including cylindrical, square, and rectangular, and may comprise one or more of concrete, fiberglass, and steel. Some embodiments of these methods may include introducing fluid containing petroleum into the tank, over the geomembrane liner and under the geomembrane cover. In some embodiments, the geomembrane cover includes a passive vent. Some embodiments of these methods may also include positioning a sump on top the geomembrane cover.

Some embodiments of the present methods comprise assembling (e.g., attaching to one or more of each other) multiple pieces to form a cover comprising a hydrocarbon-resistant geomembrane (more specifically oil-resistant, and even more specifically petroleum-resistant). Some embodiments of such methods may include attaching the cover to a tank to substantially cover the tank. Some of these embodiments may also comprise attaching the geomembrane cover to a geomembrane liner; in some such embodiments, at least a portion of the cover may be in direct contact with at least a portion of the liner. Some embodiments of such methods may include positioning one or more floats under and/or over the geomembrane cover, and, in some embodiments, attaching the one of more of such floats to the geomembrane cover and/or the tank. Some embodiments of such methods may also include positioning one or more weights, which can include pipes and/or sand, on top of the geomembrane cover. In some such embodiments, one or both of the geomembrane cover and liner are sufficiently flexible that at least portions of either can fold over on themselves without destroying the geomembrane cover/liner or, in some embodiments, without compromising the structural integrity of the geomembrane cover/liner. Some of these embodiments may also comprise attaching a structure to the tank that is configured to retain one or more pipes that can transport fluids (including at least one of a liquid and a gas) into and/or out of the tank; such structures may, in some embodiments, comprise two portions that are angled with respect to each other, one of which includes an open region (such as an enclosed opening or a slot that is not completely enclosed) sized such that such a pipe may be positioned in the open region, and, in some more specific embodiments, configured such that multiple such pipes may be so positioned. In some embodiments, the structure may take the form of a flange, and the portion configured with an open region may have, in some embodiments, a rectangular shape or a non-rectangular shape (such as a trapezoidal shape); in some such embodiments, the portion that includes the open region may be oriented at an angle relative to the other portion of the structure such that when the structure is attached to a tank, the portion that includes the open region may extend into the tank (meaning into the region of the tank that is bounded by the side wall or side walls of the tank (where liquid can be held)). Some embodiments of these methods may include positioning one or more pipes in such open region. Some embodiments of these methods may include attaching at least one of the geomembrane cover and the geomembrane liner to the pipe-retention structure. The tank to which the geomembrane cover and/or geomembrane liner may be attached may have any shape, including cylindrical, square, and rectangular, and may comprise one or more of concrete, fiberglass, and steel. Some embodiments of these methods may include introducing fluid containing petroleum into the tank, over the geomembrane liner and under the geomembrane cover. In some embodiments, the geomembrane cover includes a passive vent. Some embodiments of these methods may also include positioning a sump on top the geomembrane cover.

Some embodiments of the present methods include attaching a flange to a tank, where the flange is configured to hold one or more pipes in position relative to the tank so that the one or more pipes can be used to introduce fluid (the fluid containing hydrocarbons, oil, and/or petroleum) into the tank.

In an embodiment, a tank cover system comprises a petroleum-resistant geomembrane, floats that can be disposed underneath the petroleum-resistant geomembrane, and weights that can be disposed on top of the petroleum-resistant membrane.

In another embodiment, a pipe retention system comprises a flange comprises a first segment comprising one or more first openings, and a second segment oriented at a non-zero angle to the first segment and comprising one or more second openings, where at least one second opening in the one or more second openings is larger than at least one first opening in the one or more first openings.

In still another embodiment, a pipe retention system comprises a flange comprises a first segment configured to be secured to a tank, and a second segment connected to and oriented at a non-zero angle to the first segment and comprising one or more openings sized to receive one or more three-inch or larger diameter pipes, respectively.

In yet another embodiment, a tank cover system attached to a tank having a side wall and a top flange and containing liquid that includes petroleum, comprises a geomembrane in contact with the liquid and attached to the top flange with multiple bars and multiple fasteners, floats coupled to at least one of an underside of the geomembrane and the tank, and weights positioned on the geomembrane.

In an additional embodiment, a tank covering method comprises attaching a petroleum-resistant geomembrane to a tank, where the attaching includes using fasteners to attach at least a portion of the petroleum-resistant geomembrane to a first flange and using fasteners to attach at least another portion of the petroleum-resistant membrane to a second flange that has a portion oriented at a non-zero angle to the first flange, attaching floats to an underside of the petroleum-resistant membrane, and positioning weights on a top side of the petroleum-resistant membrane.

In another embodiment, a tank covering method comprises attaching a petroleum-resistant geomembrane to a tank, where the attaching includes using bars and fasteners to attach at least a portion of the petroleum-resistant geomembrane to a first flange attached to a side wall of the tank, and using fasteners to attach at least another portion of the petroleum-resistant membrane to a second flange attached to the side wall of the tank, the second flange include at least one opening, attaching at least one float to an underside of the petroleum-resistant membrane, and positioning at least one weight on a top side of the petroleum-resistant membrane, and positioning at least one pipe through the at least one opening in the second flange.

The ballast weights may form a sump to collect liquids on the top surface of the flexible membrane, and the sump may be centrally located.

The flexible membrane may comprise a petroleum resistant geomembrane.

The floats may extend inwardly from a perimeter of the cover toward a center of the cover.

The ballast weights may be disposed around a perimeter of the tank or the ballast weights may be provided in the central portion of the tank.

The floats may comprise floats disposed in a center of the cover. A gas vent may be disposed at the center of the cover, and the gas vent may be a passive vent.

The cover may be sealingly attached to a top flange formed at a top edge of the tank wall.

The may comprise a foam member wrapped in a geomembrane and the floats may be attached to the cover by welding.

The term "coupled" is defined as connected, although not necessarily directly. The terms "a" and "an" are defined as one or more unless this disclosure explicitly requires otherwise.

The terms "substantially," "approximately," and "about" are defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, or a component of a system, that "comprises," "has," "includes" or "contains" one or more elements or features possesses those one or more elements or features, but is not limited to possessing only those elements or features. Likewise, a method that "comprises," "has," "includes" or "contains" one or more steps possesses those one or more steps, but is not limited to possessing only those one or more steps. Additionally, terms such as "first" and "second" are used only to differentiate structures or features, and not to limit the different structures or features to a particular order.

A device, system, or component of either that is configured in a certain way is configured in at least that way, but it can also be configured in other ways than those specifically described.

Any embodiment of any of the systems and methods can consist of or consist essentially of—rather than comprise/include/contain/have—any of the described elements, features, and/or steps. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Details associated with the embodiments described above and others are presented below.

BRIEF DESCRIPTION OF THE DRAWING

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DESCRIPTION OF ILLUSTRATIVE EMBODIMENTS

The following detailed description and drawings provide some non-limiting and non-exhaustive embodiments of the present cover systems, tank covering methods, and pipe retention systems. Embodiments of the present cover systems may be coupled to liquid storage tanks to cover liquid comprising oil, such as petroleum that is extracted from the earth through a process like hydraulic fracturing.

Figure 1:
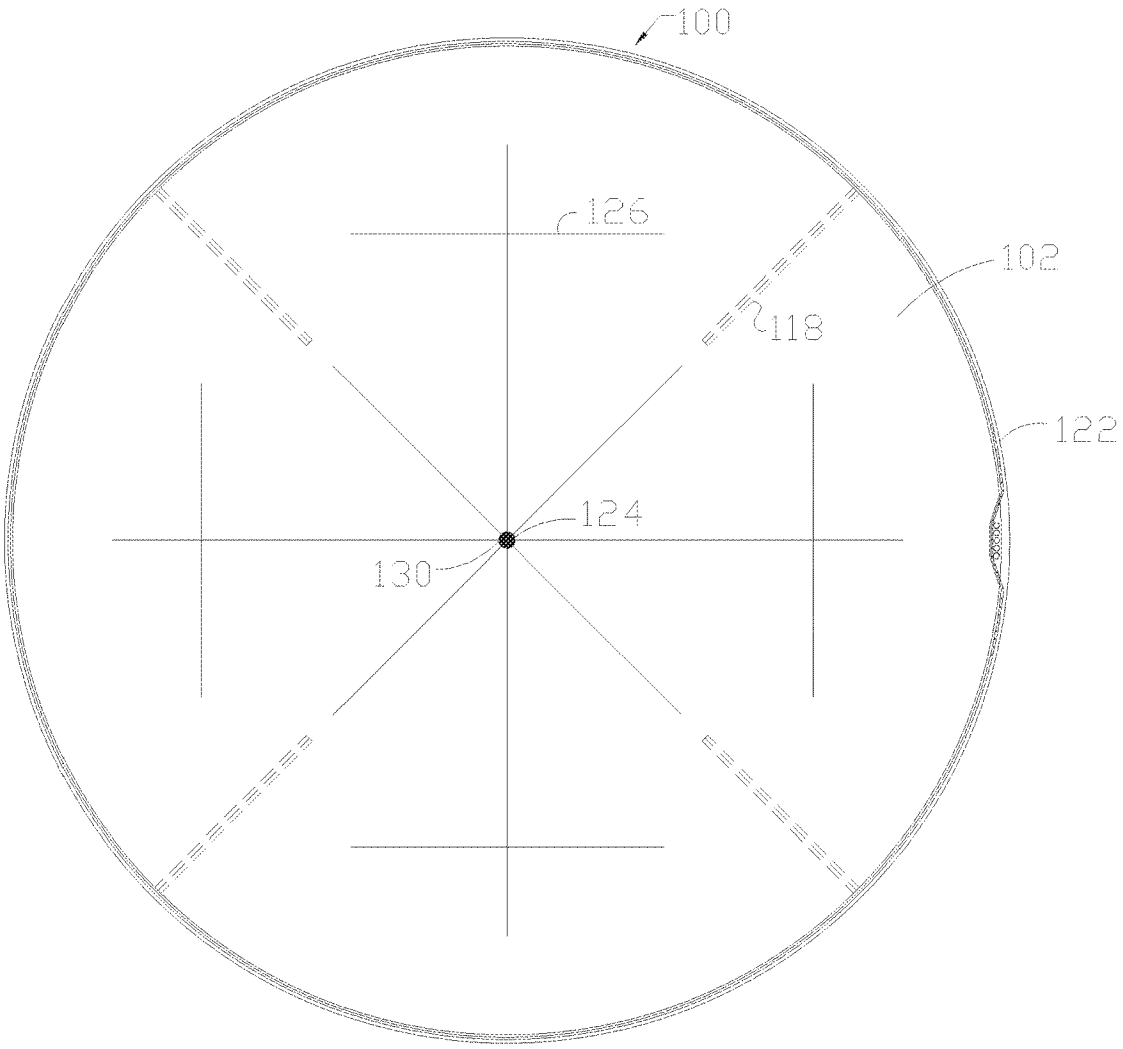
FIG. 1 is a top view of one embodiment of the present cover systems coupled to a liquid storage tank.
Figure 2A:
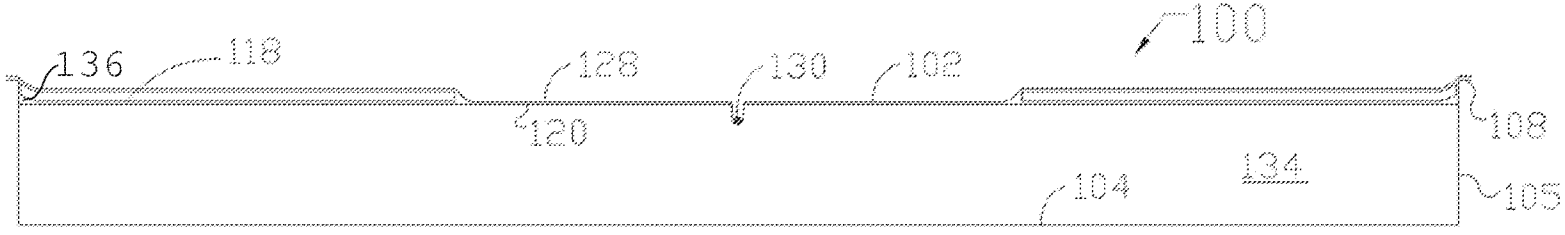
FIGS. 2A, 2B and 2C are sectional views of the cover system and liquid storage tank of FIG. 1 in full, partially full, and empty profiles, respectively.
Figure 2B:
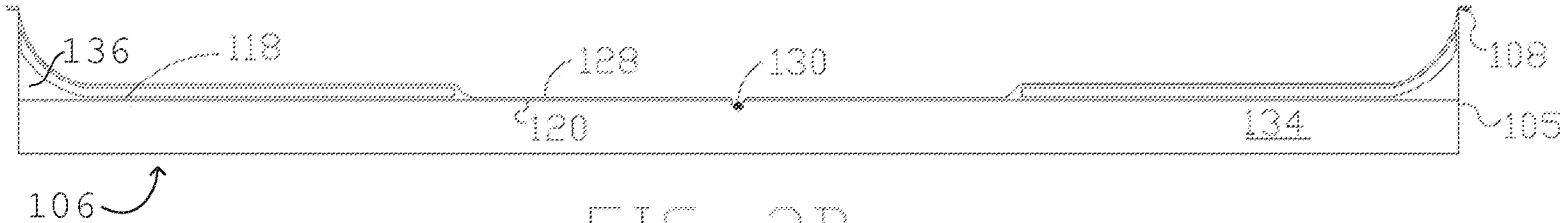
Figure 2C:
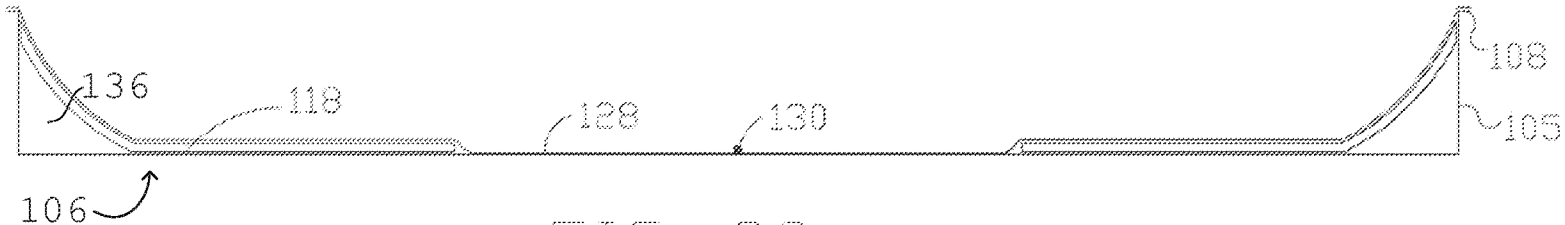

Referring to FIGS. 1-2C, a tank cover system 100 for a storage tank 106 comprises a substantially liquid impervious flexible membrane 102. The flexible membrane may be formed of a geomembrane comprising a material which is petroleum-resistant, oil-resistant, hydrocarbon-resistant or otherwise resistant to exposure to oil or other chemicals. The geomembrane may be from 10 to 100 mil (1/1000th of an inch) thick. The flexible membrane 102 may comprise multiple pieces, each of which is attached to at least one other piece.

The pieces may be fabricated from rolls that are 5 to 25 feet wide by seaming the panels together. The seams may be thermally welded, chemically bonded, or ultrasonically welded, or joined by any means that forms a substantially liquid impervious seal. Example of materials suitable for use as such geomembranes are XR-5® brand geomembranes, available from and/or made by Seamen Corporation (Wooster, Ohio).

In an embodiment, a plurality of floats 118 are disposed under the bottom surface 120 of the flexible membrane 102. In the embodiment illustrated in FIG. 1, four floats 118 are provided and each float 118 extend radially inwardly from a perimeter 122 of the storage tank 106 toward a center 124 of the storage tank 106. In one embodiment, the length of the floats ranges from 10-50% of the diameter of the tank. The floats may be attached to the side wall 105 of the storage tank 106 or may be attached to the flexible membrane 102. The floats may be any size appropriate to support the flexible membrane. For example, they may be about 4 to 24 inches wide and 4 to 24 inches tall, and in one embodiment, they are 6" tall×12" wide.

The floats 118 help lift the flexible membrane 102 when the storage liquid is added to the storage tank 106. The floats 118 also ensure that the flexible membrane 102 remains on the surface of the liquid if it is ripped, torn or otherwise leaks. Additionally, the floats 118 form gas flow channels (discussed further below) to channel gas vapor trapped under the flexible membrane 102 toward the perimeter 122 of the storage tank 106. They also help funnel rainwater or other liquids which may accumulate on the top surface of the flexible membrane 102 toward a sump 130 formed near the center 124 of the flexible membrane 102.

In an embodiment, a plurality of ballast weights 126 are provided on the top surface 128 of the flexible membrane 102. The ballast weights 126 may be provided by themselves or may be provided in conjunction with the floats 118. In the embodiment illustrated in FIG. 1, the ballast weights 126 are arranged radially in a spoke like pattern in the center 124 of the storage tank 106 with cross arms 132. The ballast weights form a sump 130 in the center 124 of the flexible membrane 102. The sump 130 collects rainwater and other liquids which may accumulate on the top surface 128 of the flexible membrane 102. The ballast weights 126 prevent the flexible membrane 102 from lifting off the surface of the liquid in high winds or the like. The ballast weights 126 may be sand-filled tubes, as will be discussed in further detail below.

The cover system 100 may be used to cover a liquid storage tank 106 in accordance with an exemplary embodiment. The liquid storage tank 106 has a side wall 105 which extends upwardly from a bottom wall 104. The side wall 105 and bottom wall 104 may be formed of any suitable substantially liquid impervious material. The bottom wall 104 may be formed by placing a substantially liquid impervious membrane on a surface, such as packed earth. The storage tank may be any size, and in one embodiment is 120 feet in diameter. The side wall 105 may be modular so that the storage tank 106 may be easily assembled and disassembled for transportation, construction and use. In an embodiment, the modules may be approximately 12 feet tall by 15 feet long. The storage tank may be constructed of concrete, fiberglass, steel or any other suitable material. The tank may be any desired shape, including circular, square or rectangular.

Figure 15:
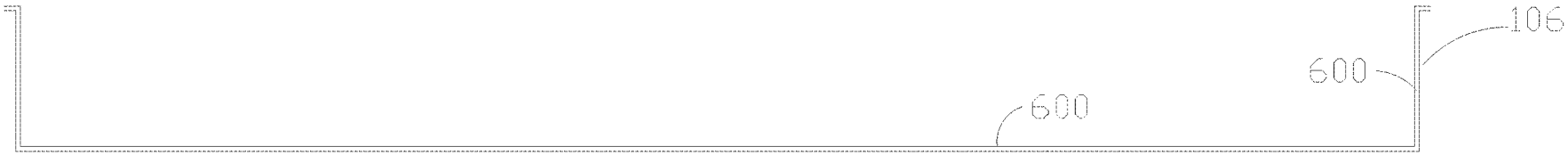
FIG. 15 is a sectional view of a liner of the present cover systems coupled to a liquid storage tank.

In an embodiment illustrated in FIG. 15, a lining 600 is provided for the tank 106 to cover the bottom wall and side wall of the tank. The liner is secured at or near a top of the tank wall. The lining 600 prevents contact between the contents of the tank and an inner surface of the tank. The lining 600 may be a flexible membrane, and in one embodiment, comprises a geomembrane which is petroleum-resistant, oil-resistant, hydrocarbon-resistant or otherwise resistant to exposure to oil or other chemicals.

Figure 6:
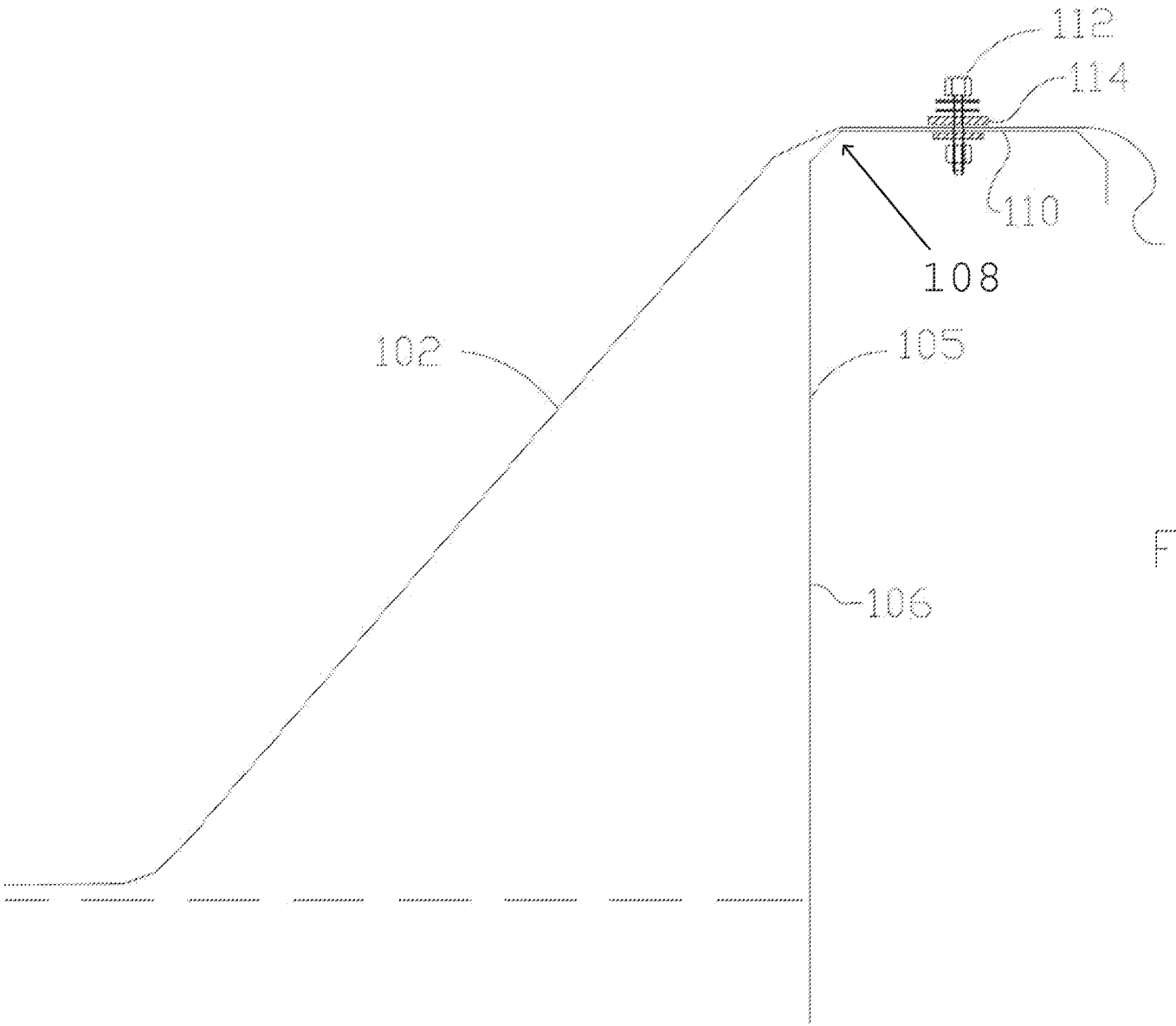
FIG. 6 is a sectional view of a detail of one embodiment of the present cover systems that is coupled to a liquid storage tank, showing the attachment of a flexible membrane of the cover system to the side wall of the liquid storage tank.

In one embodiment, shown in FIG. 6, a flange member 110 extends laterally from the top edge 108 of the side wall 105. The flange member may be substantially horizontal. The flexible membrane 102 is sealed to the top of flange member 110. The flexible membrane 102 may be attached by one or more batten bars 114 which comprise openings for bolts 112 or other fasteners. The flexible membrane 102 may comprise openings to allow passage of the bolts 112. The openings may be located on the perimeter 122 of the flexible membrane 102 within 2 feet of the perimeter 122 of the flexible membrane. The batten bars 114 may comprise angle iron. The batten bars 114 press the flexible membrane 102 firmly against the top flange member 110. A sealant (not illustrated) may be provided between the flexible membrane 102 and the top flange member 110. The sealant may be a flexible tape. The flexible membrane 102, bottom wall 104, and side wall 105 form a substantially sealed interior volume 116 for receiving a storage liquid.

FIGS. 2A, 2B and 2C are sectional views of the liquid storage tank of FIG. 1 in full, partially full, and empty profiles, respectively. As seen in FIG. 2C, when the storage tank 106 is empty, the flexible membrane 102 rests on the bottom wall 104 of the tank. The flexible membrane 102 stretches across the tank. A vapor collection chamber 136 where vapors may accumulate and be transmitted from the floats is formed at the perimeter the tank between the side walls and the membrane. As seen in FIG. 2B, as the storage tank 106 is filled, the flexible membrane 102 floats on the surface of the liquid 134. As liquid 134 fills the storage tank 106, the vapor collection chamber 136 becomes smaller. As seen in FIG. 2A, when the storage tank 106 is full, the flexible membrane 102 floats on the surface of the liquid 134. The sump 130 forms a depression in the center of the flexible membrane 102. The plurality of ballast weights 126 direct water or other liquids on the top surface 128 of the flexible membrane 102 toward the sump 130. Further, when the storage tank 106 is substantially full, the vapor collection chamber 136 shrinks so that there is substantially no space for vapor to accumulate. A vent (not illustrated) may be provided to allow vapors to exit the vapor collection chamber 136.

Figure 3:
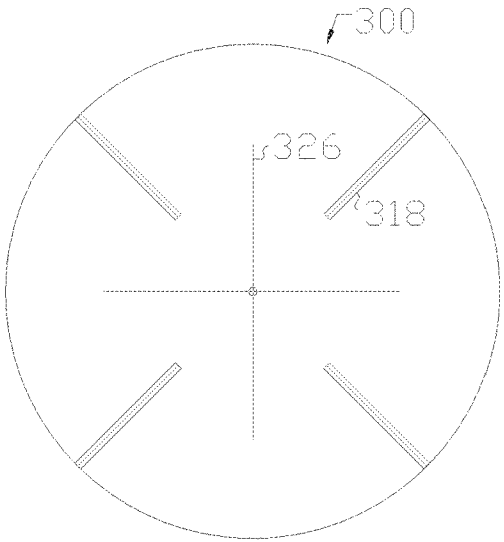
FIG. 3 is a top view of another embodiment of the present cover systems coupled to a liquid storage tank.

FIG. 3 is a plan view of a cover 300 in accordance with another exemplary embodiment. In the embodiment illustrated in FIG. 3, a plurality of floats 318 are arranged in a similar manner to the embodiment illustrated in FIG. 1. In this embodiment, the floats 318 may be disposed on top of the cover 300 and a plurality of ballast weights 326 are arranged in a different radial spoke like pattern (i.e., no arms are provided). Such a configuration may be suitable for a smaller diameter tank, such as a 60 feet diameter tank. One skilled in the art will recognize that other configurations of the ballast weights 326 are also possible. In other respects, the cover 300 functions like the previously described cover 100.

Figure 4:
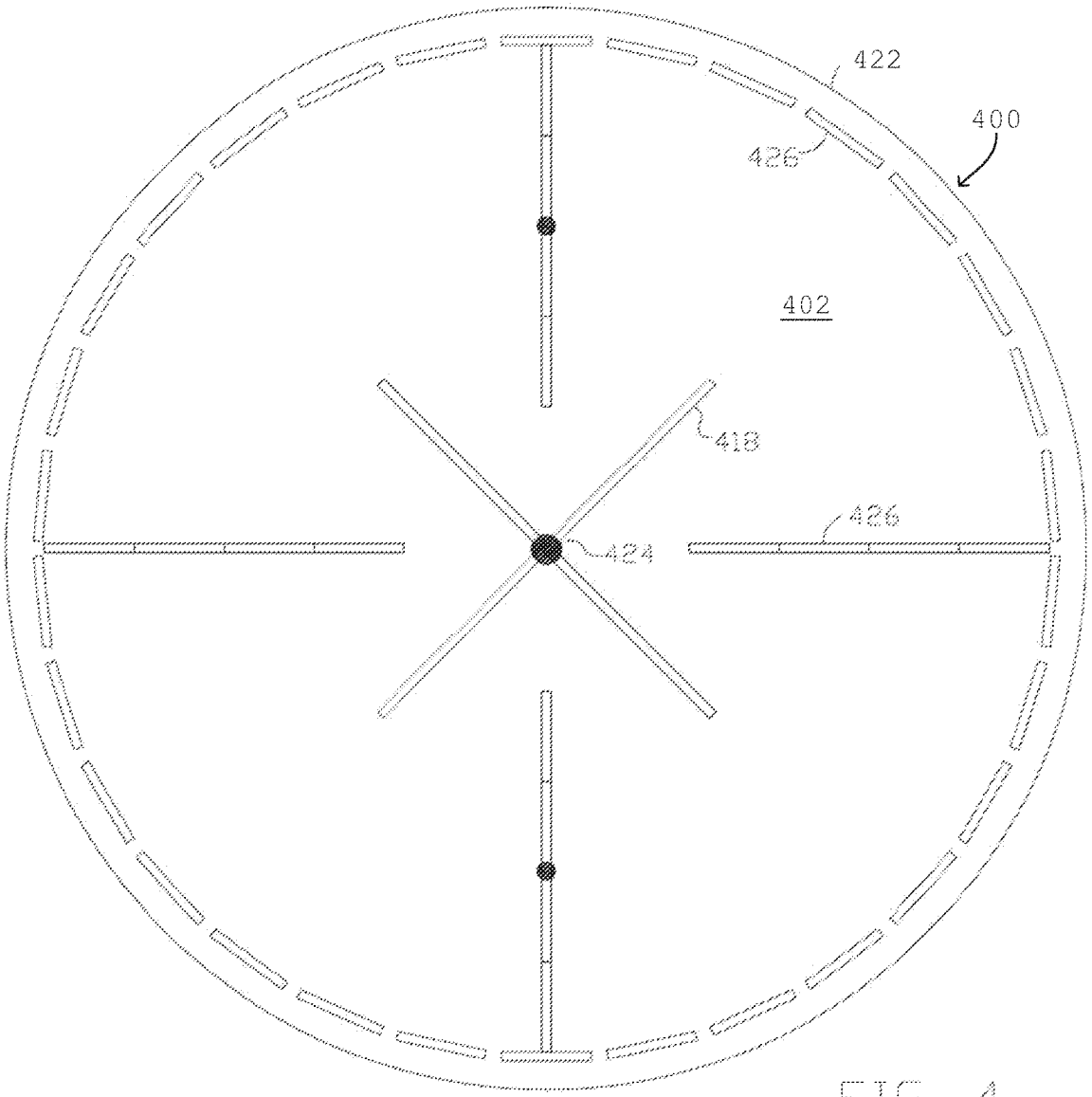
FIG. 4 is a top view of still another embodiment of the present cover systems coupled to a liquid storage tank.

FIG. 4 is a plan view of a cover 400 in accordance with another exemplary embodiment. In the embodiment illustrated in FIG. 4, a plurality of ballast weights 426 are disposed around the perimeter of the flexible membrane 402. Additionally, a plurality of ballast weights 426 extend inwardly from a perimeter 422 of the cover 400 toward a center 424 of the cover 400. A plurality of floats 418 are arranged in a radial, spoke like pattern at the center 424 of the cover.

Figure 16:
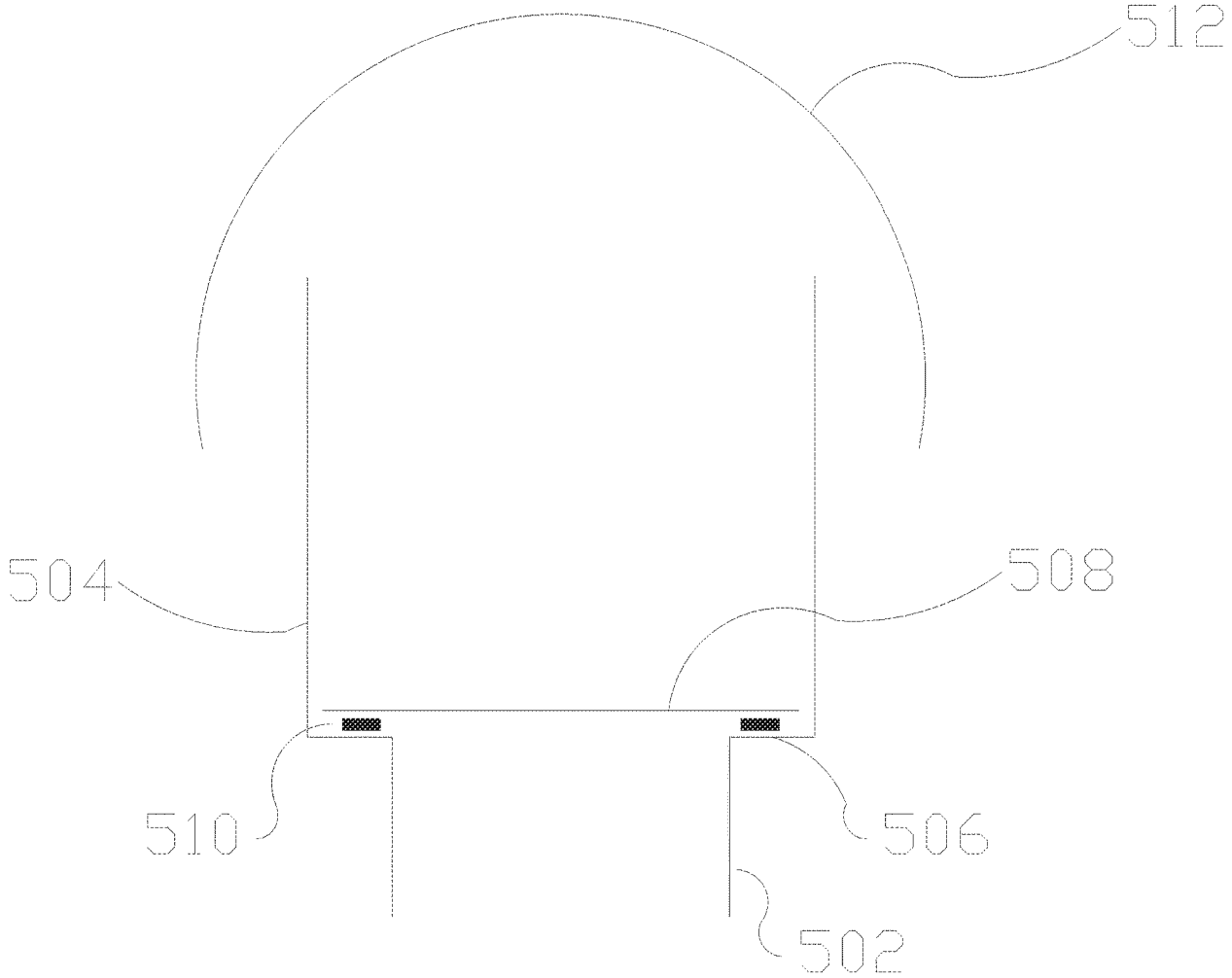
FIG. 16 is a side sectional view of a passive vent that can be a part of one of the present cover systems.

A vent 442 may be provided to vent any vapors which accumulate in the center 424 of the cover. The vent 442 may be a passive vent, as illustrated in FIG. 16. A passive vent is useful since power may be unreliable or may not be available at remote sites. As seen in FIG. 16, a passive vent 500 may comprise a gas discharge pipe 502 which is coupled to the interior of the storage tank. The vent 500 may be located at any convenient location and coupled via conduits to the area desired to be vented. For example, it may be placed at the side of the tank and coupled via conduits to the center of the cover. The gas discharge pipe 502 is coupled to a vent cylinder 504. In an embodiment, the vent cylinder 504 is a larger diameter than the gas discharge pipe 502 and forms a valve seat area 506. A vent seal plate 508 is disposed in the interior of the vent cylinder 504. The vent seal plate 508 is sized to fit into the interior of the valve cylinder 504 such that it may move up and down. A gasket 510 is disposed on the valve seat area 506. Gravity urges the vent seal plate toward the gasket to form a seal. When pressure inside the tank exceeds a certain amount, it overcomes the resistant to gravity, lifts the vent seal plate 508 and allows gas to escape (e.g., it "burps"). A rain and wind shroud 512 is provided to protect the interior of the vent cylinder 504 and minimize the accumulation of any undesirable liquids in the vent cylinder 504.

Figure 5A:
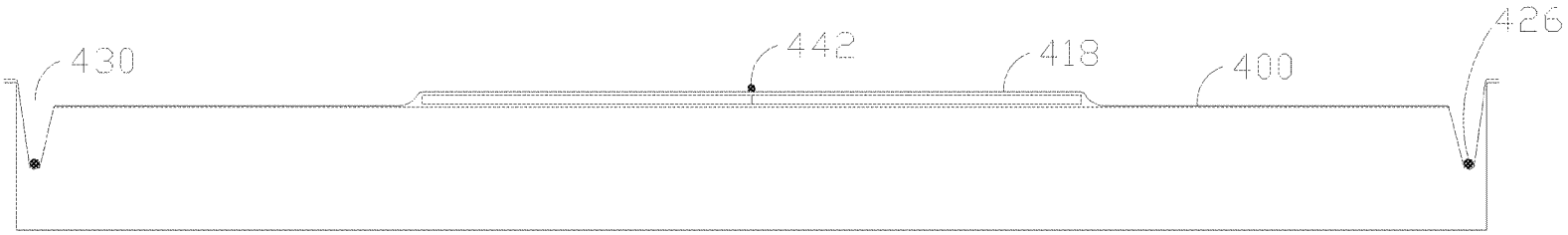
FIGS. 5A, 5B and 5C are sectional views of the cover system and liquid storage tank of FIG. 4 in full, partially full, and empty profiles, respectively.
Figure 5B:
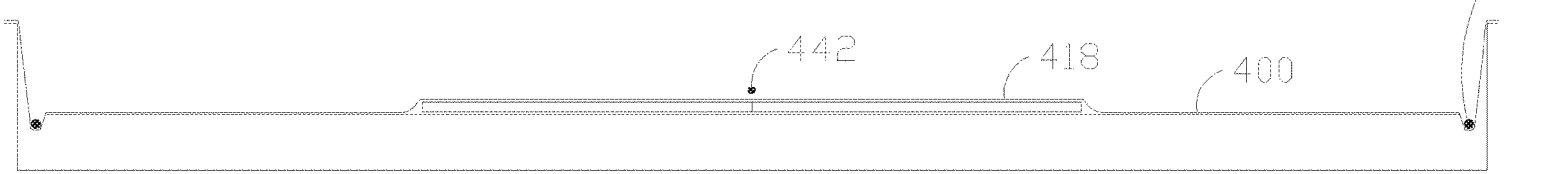
Figure 5C:
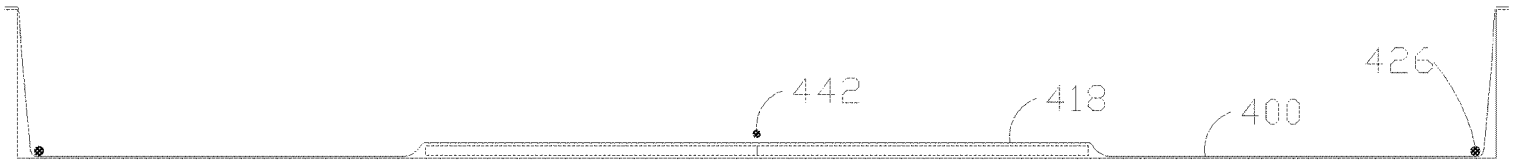

FIGS. 5A, 5B and 5C are sectional views of the liquid storage tank of FIG. 4 in full, partially full, and empty profiles, respectively. The operation of the storage tank 400 is substantially similar to the operation of the tank 106, with two notable differences. First, the perimeter ballast weights 426 help take up any slack in the flexible membrane 102 as the storage tank is filled and emptied. Therefore, a vapor collection chamber is not formed at the perimeter of the storage tank 400, and vapor is directed toward the vent 442. Second, the sump 430 formed by the plurality of ballast weights 426 is formed at the perimeter of the storage tank 400.

Figure 7:
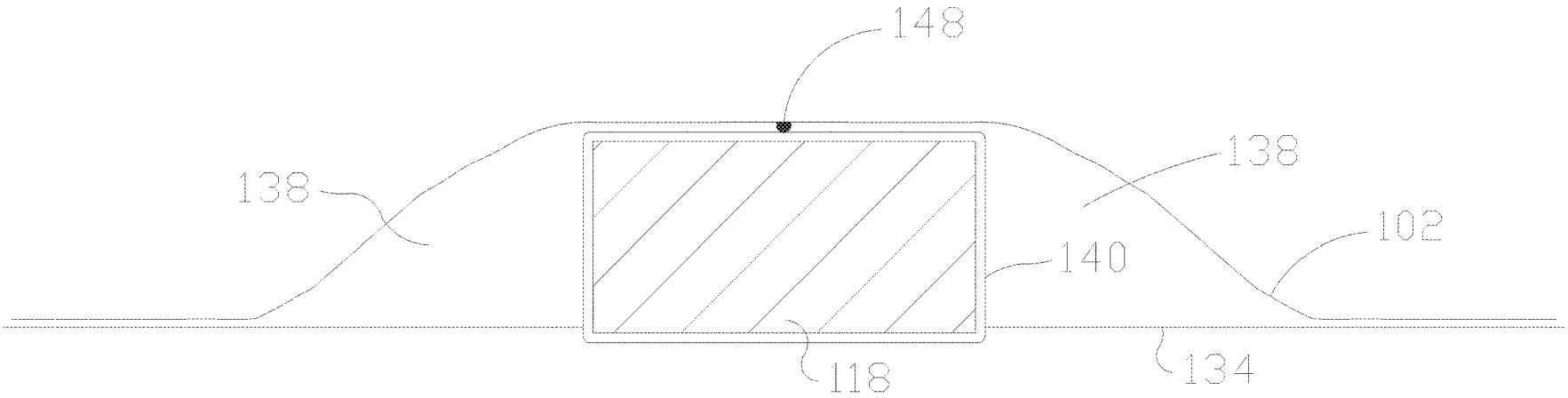
FIG. 7 is a sectional view of a detail of one embodiment of the present cover systems, showing a lateral float positioned under and coupled to a flexible membrane of the cover system.

FIG. 7 is a sectional view of an embodiment of a float 118. The float 118 may be formed of foam (for instance, a closed cell foam) or any other material which is less dense than a liquid stored in the tank. To protect the float, it may be surrounded by a separate membrane 140, which may be formed of the same petroleum resistant geomembrane material as the flexible membrane 102 or of an HDPE material. The membrane 140 may be welded to the flexible membrane 102 with a weld 148 to couple the float to the flexible membrane 102. This construction forms vapor flow zones 138 between the surface of the liquid 134 and the membrane 140 on both sides of the float 118. Vapor may be collected in the vapor flow zones 138 and channeled to the vapor collection chamber 136 or a vent.

Figure 8A:
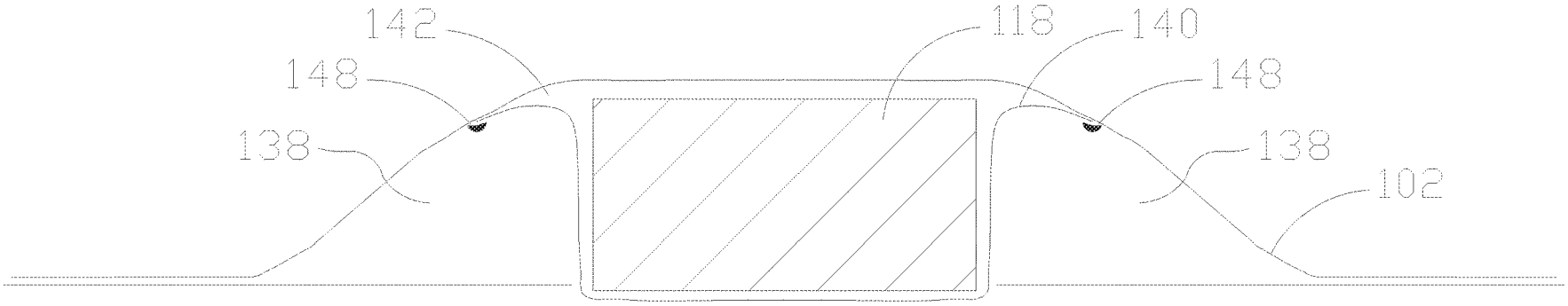
FIG. 8A is a sectional view of a detail of another embodiment of the present cover systems, showing a lateral float positioned under and coupled to a flexible membrane of the cover system in a different manner than is illustrated in FIG. 7.

FIG. 8A is a sectional view of another embodiment of a float 118. In this embodiment, the float 118 is attached to the flexible membrane 102 by forming a pocket 142 with a membrane 140 welded to the flexible membrane 102. The membrane 140 may be formed of the same petroleum resistant geomembrane material as the flexible membrane 102 or of an HDPE material. The membrane 140 may be continuously welded with welds 148 to the flexible membrane 102 to surround the float 118 and couple the float 118 to the flexible membrane 102. This construction forms vapor flow zones 138 between the surface of the liquid 134 and the membrane 140 on both sides of the float 118. Vapor may be collected in the vapor flow zones 138 and channeled to the vapor collection chamber 136 or a vent.

Figure 8B:
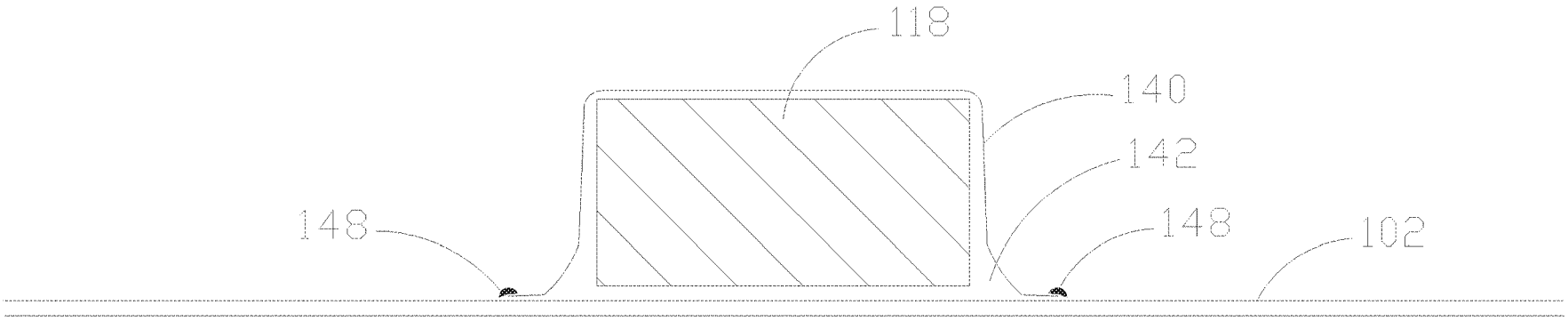
FIG. 8B is a sectional view of a detail of another embodiment of the present cover systems, showing a lateral float positioned on top of and coupled to a flexible membrane of the cover system in a different manner than is illustrated in FIG. 7.

FIG. 8B is a sectional view of another embodiment of a float 118. In this embodiment, the float 118 is attached to the flexible membrane 102 by forming a pocket 142 with a membrane 140 welded to the top surface of the flexible membrane 102. The membrane 140 may be formed of the same petroleum resistant geomembrane material as the flexible membrane 102 or of an HDPE material. The membrane 140 may be continuously welded with welds 148 to the flexible membrane 102 to surround the float 118 and couple the float 118 to the flexible membrane 102.

Figure 9:
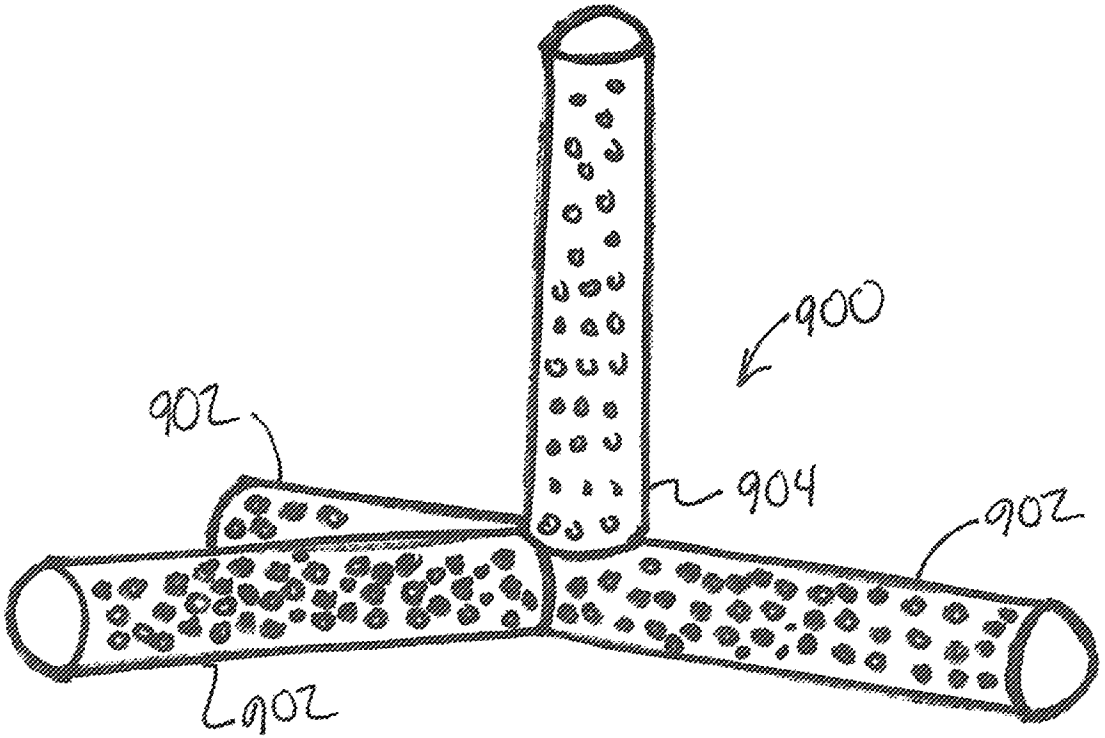
FIG. 9 is a perspective view of an embodiment of a sump collector that can be a part of one of the present cover systems.

FIG. 9 is a perspective view of an embodiment of one embodiment of a sump collector 900 for placement into the sump 130. The sump collector 900 comprises a sump bucket 904 which is open to allow access to the interior of the sump collector 900 for a hose or submersible pump to be introduced into the sump bucket 904. In one embodiment, the sump bucket 904 may be about 6" to 36" in diameter or square, 1-ft to 6-ft tall, and is fenestrated to allow water to enter to a pump that is placed inside the sump collector. The pump may be connected to a conduit that extends over the side of the tank (and preferably into a drainage area) to pump off the water and other liquid that collects in the sump. In one particular embodiment, the sump bucket 904 comprises a 16" diameter×3-ft tall plastic pipe with several hundred ½" holes. A plurality of legs 902 may be attached to the sump bucket 904 to hold the sump bucket 904 vertical, and the legs 902 may be oriented so that they are aligned with channels formed on the surface of the flexible membrane 102 by the ballast weights 126. The legs 902 form conduits and direct liquid toward the sump bucket 904. The legs 902 may be fenestrated. The sump collector 900 is typically not attached to the flexible membrane 102. It may be attached to the cover by welding if desired.

Figure 10:
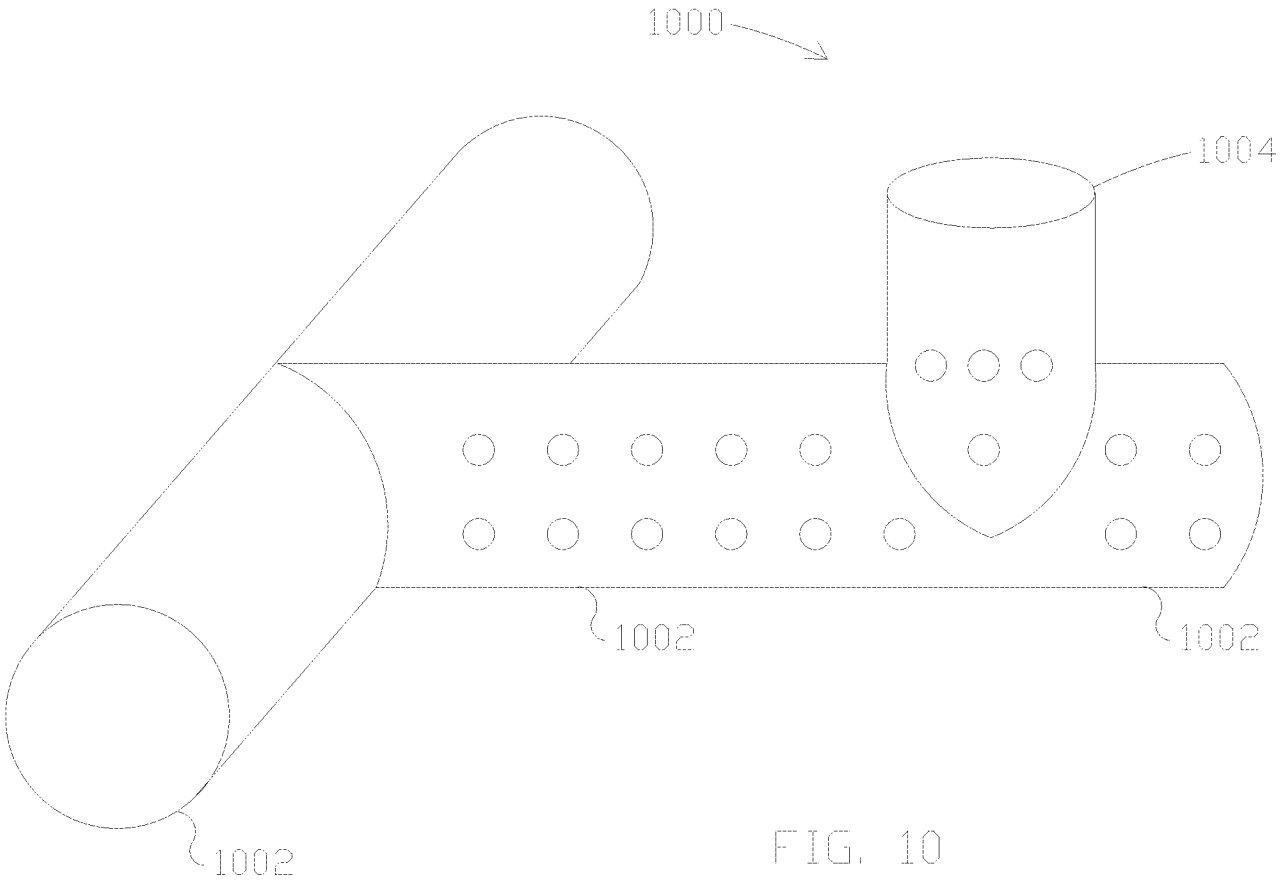
FIG. 10 is a perspective view of another embodiment of a sump collector that can be a part of one of the present cover systems.

FIG. 10 is a perspective view of another embodiment of a sump collector 1000. The sump collector 1000 of this embodiment has a fenestrated sump bucket 1004 disposed on a plurality of legs 1002. The legs 1002 are arranged in a different configuration than the legs 902 of the previously described embodiment. Otherwise, the operation and construction of the sump collector 1002 is similar to the previously described embodiment and will not be repeated.

Figure 11:
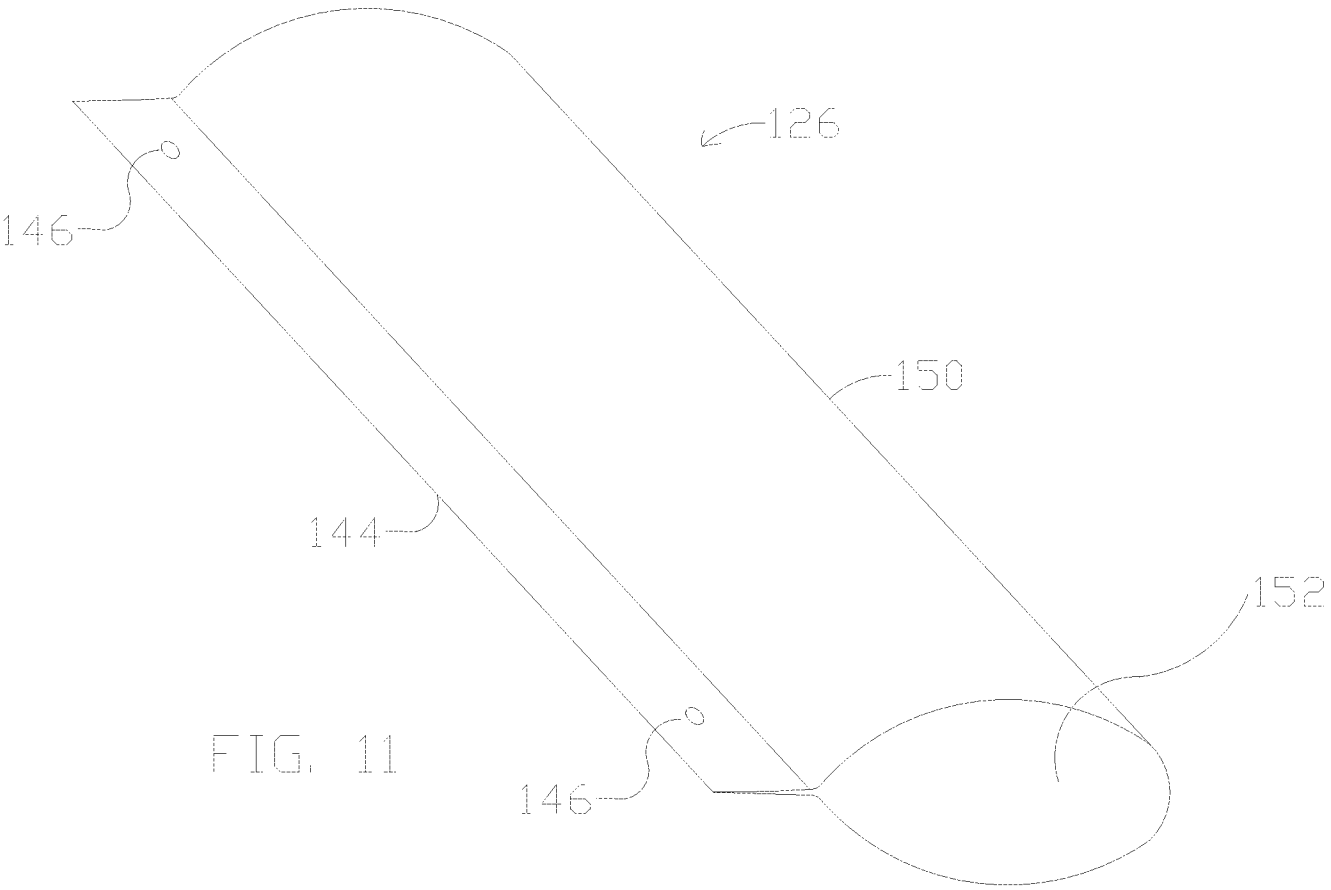
FIG. 11 is a perspective view of one embodiment of a ballast tube that can be a part of one embodiment of the present cover systems.

FIG. 11 is a perspective view of one embodiment of a ballast weight 126. The ballast weight 126 may comprise plastic tubing or a pipe 150 which is filled with sand or a slurry 152. In one particular embodiment, the ballast weight is a 10-ft long, 60-mil HDPE tube, filled with sand and sealed at the ends. The ballast weights may be about 2 to 24 inches in diameter (normally about 4"×6" oval shaped and 10-ft long) and may weigh 5 to 15 lbs. per linear foot.

The ballast weight may be attached to the flexible membrane by attachment straps or loops disposed on the surface of the flexible membrane 102. The ballast weight may be provided with an attachment flap 144 having holes 146 for receiving attachment straps disposed on the surface of the flexible membrane 102.

Figure 12:
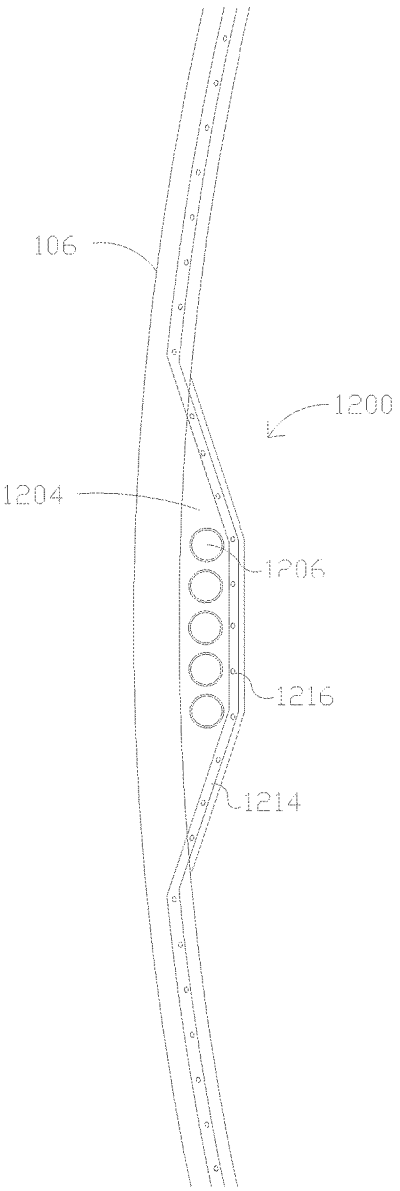
FIG. 12 is a top view showing one embodiment of the present pipe retention member coupled to a tank flange of a liquid storage tank and helping to secure multiple pipes relative to the liquid storage tank.
Figure 13:
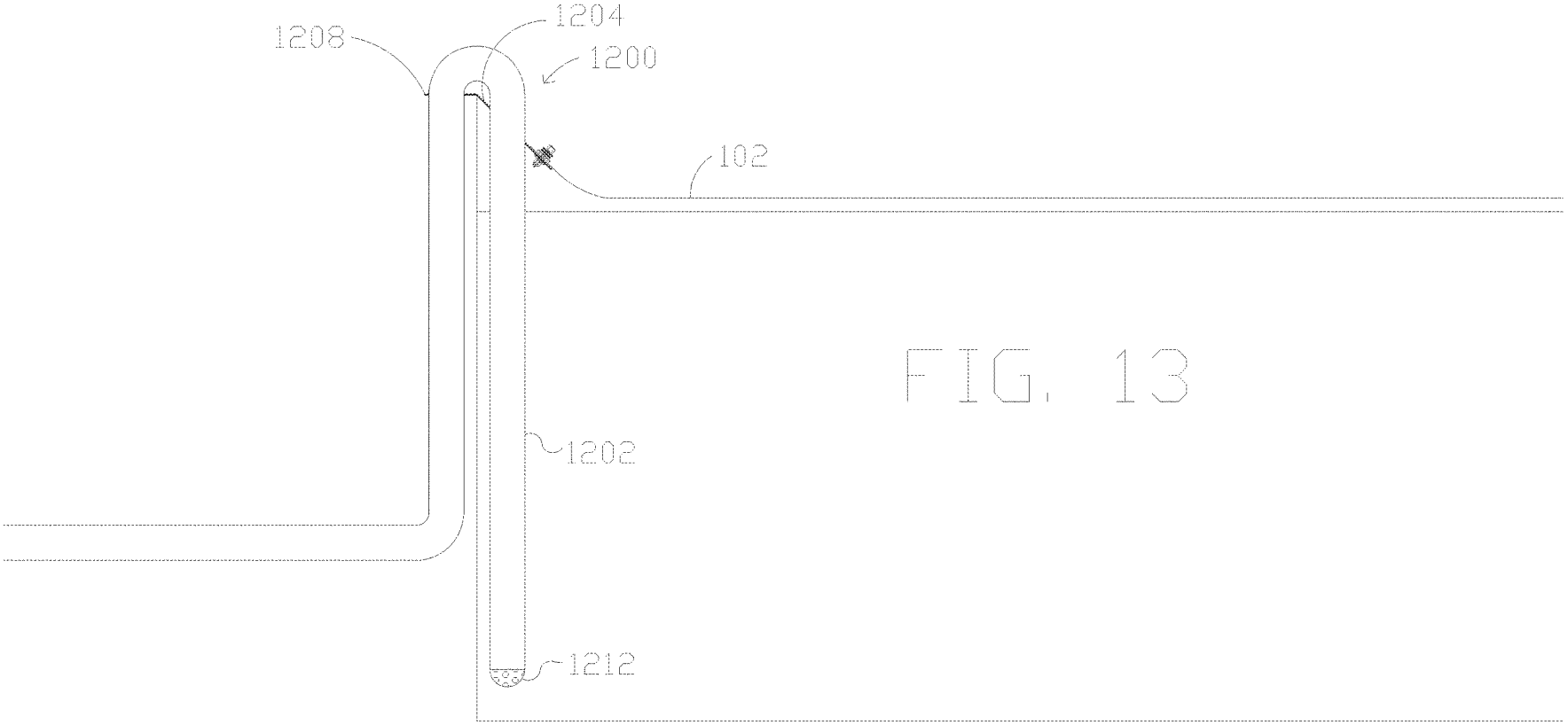
FIG. 13 is a side sectional view of the pipe retention member and one of the pipes shown in FIG. 12.
Figure 14:
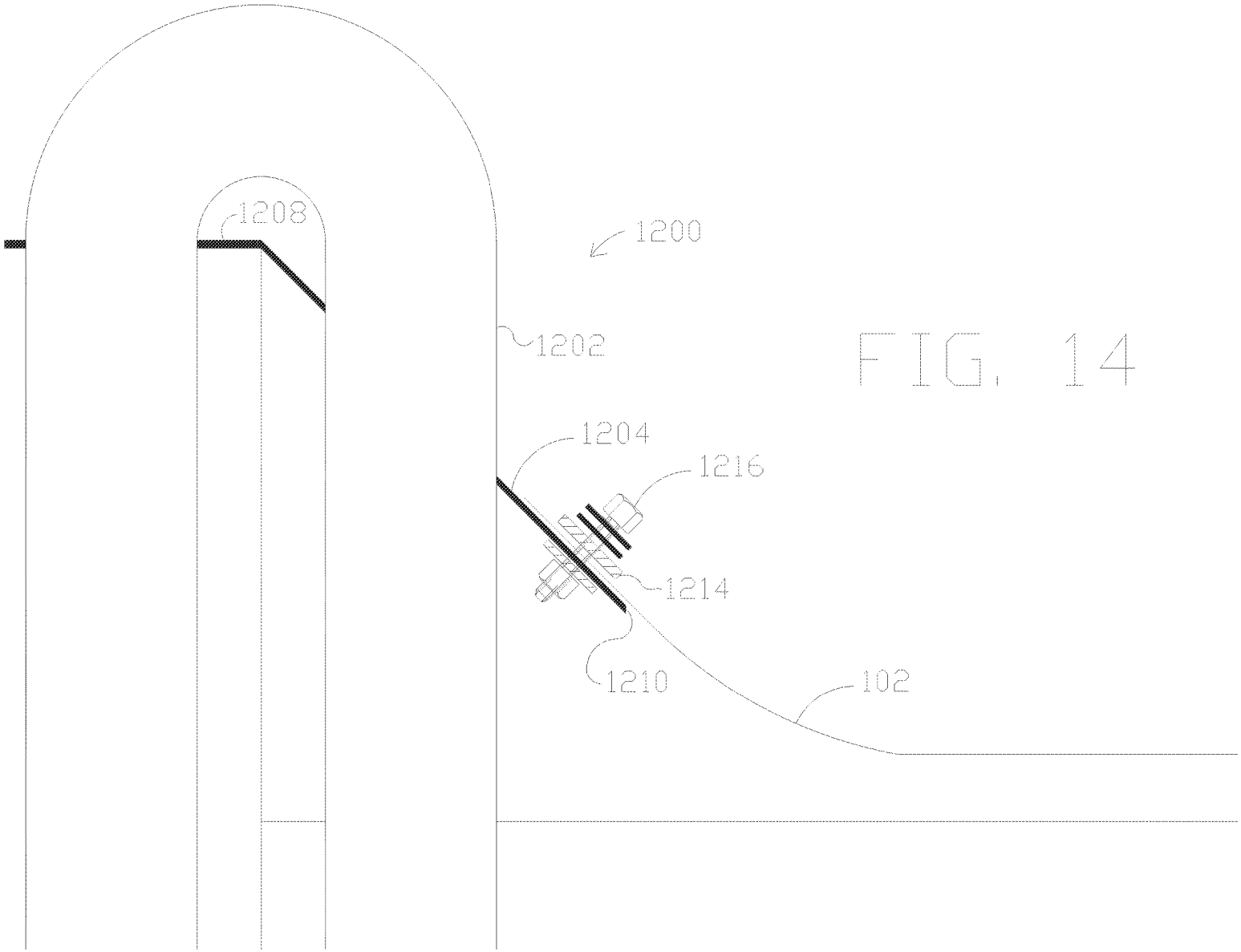
FIG. 14 is an enlarged detail view of the pipe retention member and one of the pipes shown in FIG. 12.

FIGS. 12, 13 and 14 illustrate a pipe retention system 1200 for introducing one or more pipes 1202 into the interior of the storage tank 106. The pipe retention system may optionally be used with the storage tank 106 described above. In FIG. 12, the pipes 1202 are omitted for clarity. The pipe retention system 1200 comprises a first flange 1208 and a second flange 1204 oriented at a non-zero angle to the first segment. The first flange 1208 has openings for bolts or other fasteners to allow attachment to the top flange member (see member 110 in FIG. 6) of the storage tank 106. The second flange 1204 extends inward into the interior of the storage tank 106. The second flange 1204 may be substantially parallel to the first flange 1208. Alternatively, the second flange may extend downward at a selected angle, preferably 45 degrees. The second flange 1204 includes openings 1206 for allowing pipes 1202 to pass through the pipe retention system. In the illustrated embodiment, five holes that are three inches or larger in diameter are provided, however, any number may be provided according to user desires. The holes 1206 may be sealed with plugs or other suitable covers when pipes 1202 are not in use. The flexible membrane 102 is attached to the inner edge 1210 of the pipe retention system 1200. The second segment 1204 may have openings to so that the membrane 102 can be attached with batten bars 1214 and bolts 1216 similar to the previously described attachment described above in connection with FIG. 6. The pipes 1202 may also pass through the top flange member (see member 110 in FIG. 6) of the storage tank 106 to provide extra stability. The pipes 1202 extend toward the bottom wall of the storage tank. The pipes 1202 may be provided with a screen 1212 to prevent debris from entering the pipes. The pipes 1202 may be used to pass through any fluid, including the storage liquid or the vapor that collects under the cover at the side wall of the tank. In one embodiment, a pipe is passes through the pipe flange and is attached to a passive vent.

The pipe retention system 1200 may have a size in the radial direction of ½ foot to 3 feet, and more specifically 10 inches to 20 inches. The circumferential dimension of the pipe flange may be one to 10 feet, and more specifically two to six feet in length, where the length is either a straight line length or an arc length. The first flange 1202 of the pipe retention system 1200 does not necessarily conform to the curved shape of the tank side wall 102 or the top flange member 110 of the storage tank 106. The first flange 1202 may be a rectangular segment that is oriented parallel to the ground and the second flange 1204 may be another rectangular segment that is oriented at a zero or a non-zero angle to the first rectangular segment.

The above specification and examples provide a complete description of the structure and use of exemplary embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present devices are not intended to be limited to the particular forms disclosed. Rather, they include all modifications and alternatives falling within the scope of the claims, and embodiments other than the one shown may include some or all of the features of the depicted embodiment. For example, components may be combined as a unitary structure, and/or connections may be substituted (e.g., threads may be substituted with press-fittings or welds). Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A method of covering a storage tank, comprising:

attaching a hydrocarbon-resistant liner to a storage tank, where the liner covers an interior bottom and one or more side walls of the tank to prevent contact between an inner surface of the tank and contents within the tank, the one or more side walls being perpendicular to the bottom and comprising one or more of concrete, fiberglass, and steel, and the liner extending to at least a top of the one or more side walls of the tank; and attaching a hydrocarbon-resistant geomembrane to the tank, where the geomembrane covers a majority of the tank and the contents of the tank, the contents comprising fluid that includes petroleum that is under the geomembrane and over the liner;

wherein the liner is sufficiently flexible that at least portions thereof can fold over on themselves without destroying the liner, and the geomembrane is sufficiently flexible that at least portions thereof can fold over on themselves without destroying the geomembrane.

2. The method of claim 1, further comprising:

attaching at least one float to the hydrocarbon-resistant geomembrane; and positioning at least one weight on the hydrocarbon-resistant geomembrane.

3. The method of claim 2, where the attaching at least one float comprises attaching floats to the hydrocarbon-resistant geomembrane.

4. The method of claim 3, wherein the floats are attached to a top surface of the hydrocarbon-resistant geomembrane.

5. The method of claim 3, wherein the floats are attached to a bottom surface of the hydrocarbon-resistant geomembrane.

6. The method of claim 3, where the positioning at least one weight comprises positioning weights on the hydrocarbon-resistant geomembrane.

7. The method of claim 2, where the positioning at least one weight comprises positioning weights on the hydrocarbon-resistant geomembrane.

* * * * *